US008017290B2

(12) United States Patent
Nakamura et al.

(10) Patent No.: US 8,017,290 B2
(45) Date of Patent: Sep. 13, 2011

(54) IMAGE FORMING METHOD AND IMAGE FORMING APPARATUS

(75) Inventors: Minoru Nakamura, Takarazuka (JP); Akira Izutani, Takatsuki (JP)

(73) Assignee: Ricoh Company, Ltd., Tokyo (JP)

( * ) Notice: Subject to any disclaimer, the term of this patent is extended or adjusted under 35 U.S.C. 154(b) by 726 days.

(21) Appl. No.: 12/043,633

(22) Filed: Mar. 6, 2008

(65) Prior Publication Data

US 2008/0226997 A1 Sep. 18, 2008

(30) Foreign Application Priority Data

Mar. 15, 2007 (JP) ..... 2007-067604

(51) Int. Cl.
*G03G 13/04* (2006.01)
*G03G 15/16* (2006.01)

(52) U.S. Cl. ..... 430/48; 430/108.8; 430/109.3; 430/110.2; 430/110.4; 430/123.54; 399/286

(58) Field of Classification Search ..... 430/48, 430/108.8, 109.3, 110.2, 110.4, 118.8, 123.54; 399/286
See application file for complete search history.

(56) References Cited

U.S. PATENT DOCUMENTS

| | | | | |
|---|---|---|---|---|
| 4,908,665 | A * | 3/1990 | Takeda et al. | 399/286 |
| 2005/0031980 | A1* | 2/2005 | Inoue et al. | 430/108.22 |
| 2005/0074685 | A1* | 4/2005 | Kido et al. | 430/110.2 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2007/0059625 | A1 | 3/2007 | Yamamoto et al. | |
| 2007/0166635 | A1 | 7/2007 | Yamamoto et al. | |
| 2007/0190442 | A1 | 8/2007 | Nakamura et al. | |
| 2007/0207399 | A1 | 9/2007 | Kadota et al. | |
| 2007/0218384 | A1 | 9/2007 | Matsumoto et al. | |
| 2007/0218393 | A1* | 9/2007 | Nozaki et al. | 430/110.2 |
| 2008/0038656 | A1 | 2/2008 | Yasunaga et al. | |

FOREIGN PATENT DOCUMENTS

| | | |
|---|---|---|
| JP | 06-167825 | 6/1994 |
| JP | 2000-3063 | 1/2000 |
| JP | 2002-323786 | 11/2002 |
| JP | 2003-98846 | 4/2003 |
| JP | 2003-156985 | 5/2003 |

(Continued)

OTHER PUBLICATIONS

Office Action issued Jun. 7, 2011 in corresponding Japanese Application No. 2007-067604, filed Mar. 15, 2007.

(Continued)

*Primary Examiner* — Thorl Chea
(74) *Attorney, Agent, or Firm* — Oblon, Spivak, McClelland, Maier & Neustadt, L.L.P.

(57) ABSTRACT

Objects of the present invention are to provide an image forming method and image forming apparatus which can secure stable toner transferability, prevent reverse transfer of the toner back to a latent image bearing member, have excellent fixing ability and produce high-quality images. The image forming method includes a one-component developing step with a toner and transferring step with an intermediate transfer member, wherein the developing step uses a developing roller having a diameter of 8 mm to 15 mm, and the toner has an adherence Fh (nN) of the toner to a flat surface satisfying the relation represented by the formula (1) and adherence Fr (mN) among the toner particles satisfying the relation represented by the formula (2):

$$15 \leq Fh \leq 50 \quad (1)$$

$$100 \leq Fr \leq 400 \quad (2).$$

20 Claims, 5 Drawing Sheets

FOREIGN PATENT DOCUMENTS

| | | |
|---|---|---|
| JP | 2005-55534 | 3/2005 |
| JP | 2005-99878 | 4/2005 |
| JP | 2005-173624 | 6/2005 |
| JP | 2006-201706 | 8/2006 |
| JP | 2006-285188 | 10/2006 |

OTHER PUBLICATIONS

Japanese Information Offer Form dated Apr. 16, 2011 received in corresponding Japanese Application No. 2007-067604.

* cited by examiner

IMAGE FORMING METHOD AND IMAGE FORMING APPARATUS

BACKGROUND OF THE INVENTION

1. Field of the Invention

The present invention relates to an image forming method and image forming apparatus which use a developer containing a toner for developing an electrostatic image.

2. Description of the Related Art

Recently, downsizing of toner particles in diameter has been promoted to give images of higher quality, which is accompanied by problems resulting from decreased toner flowability. Toner particles become easy to flocculate as their flowability decreases, degrading their transferability and causing falling-off of the images obtained. The problems resulting from degraded transferability caused by decreased toner flowability are more pronounced in toners which contain a releasing agent, e.g., wax, to prevent twining of toner particles on a transfer medium around a fixing roller, or off-setting of toner. The twining means a phenomenon in which while toner images transferred onto a recording medium, e.g., transfer paper (hereinafter sometimes referred to as transfer medium) are fixed by a fixing roller or the like, a toner twines around the fixing roller, because it cannot be completely removed from the roller, or a recording medium cannot be smoothly discharged because it is caught by a separating nail, if provided. The off-setting means a phenomenon in which, while toner images transferred onto a recording medium are fixed by a fixing roller, the toner moves towards the fixing roller and contaminates the recording medium. Moreover, problems caused by degraded toner transferability are particularly pronounced in full-color toners used in full-color image forming apparatuses.

One-component developing devices, which are advantageous for reducing printer size, are strongly demanded to be smaller, from the view point of space-saving and increased freedom of printer setting. Each component in developing units is also required to be smaller, as toner transfer mechanisms in the devices become smaller. However, reduction in size of each component in the devices causes following problems.

Reducing diameters of developing and toner supply rollers, the former for developing toner images on an image bearing member and the latter for supplying a toner to a developing roller, will decrease toner supply rate, with the result that the device may not well keep up with toner requirements (i.e., insufficient toner followability) and produce uneven images. This problem resulting from the poor followability due to the decreased developing roller diameter is more pronounced when toner particles become smaller and still more pronounced with toners incorporated with a releasing agent, e.g., wax.

Use of a cleaner-less photoconductor is one of the measures for downsizing image forming apparatuses. Such a photoconductor can contribute to space-saving, because it needs no cleaning blade mechanism. However, use of a cleaner-less photoconductor causes problems in a transfer step carried out in multi-color image forming apparatuses, in which toner images developed on a latent image bearing member, e.g., photoconductor drum, are transferred sequentially onto a transfer medium, e.g., transfer paper, or intermediate transfer member, e.g., intermediate transfer belt, with which the latent image bearing member comes into contact. These problems are caused by reverse transfer, in which a toner image is transferred from the transfer medium back to the latent image bearing member while the subsequent image is transferred, to cause color contamination and degrade quality of multi-color images. The problems resulting from the reverse transfer are more pronounced in toners of reduced particle diameter.

Several attempts have been proposed to solve these problems. For example, Japanese Patent Application Laid-Open (JP-A) No. 2003-98846 discloses a proposal of a technique which uses a toner in which the surface of the resin base particle is coated with an external additive to have enhanced adherence between an image bearing member or intermediate transfer member and toner over that among toner particles for image forming apparatuses having an intermediate transfer member, to prevent reverse transfer caused by discharge at the transfer section and thereby to prevent serious image defects, e.g., image falling off. JP-A No. 2002-323786 proposes use of toners having non-electrostatic adherence of 15 nN or less and flocculation degree of 6% or more, to prevent reverse transfer of toner from a transfer medium, e.g., intermediate transfer belt, to a latent image bearing member, e.g., photoconductor drum.

However, the invention disclosed by JP-A No. 2003-98846, which merely specifies a relative adherence relationship, is difficult to sufficiently prevent reverse transfer. Meanwhile, the invention disclosed by JP-A No. 2002-323786 is also difficult to sufficiently prevent reverse transfer, because of insufficient adherence. In particular, these inventions disclosed by JP-A Nos. 2003-98846 and 2002-323786 are difficult to sufficiently prevent reverse transfer, when a toner composed of relatively small particles is used for one-component development in a full-color image forming apparatus, to cause color contamination and deterioration of multi-color image quality.

BRIEF SUMMARY OF THE INVENTION

The present invention has been developed to solve the problems involved in the related arts described above. It is an object of the present invention to provide an image forming method and an image forming apparatus which can secure stable toner transferability irrespective of toner consumption amounts; prevent reverse transfer of a toner from an intermediate transfer member, e.g., intermediate transfer belt, back to a latent image bearing member, e.g., photoconductor drum; and has excellent fixing ability in a fixing process which employs no oil-aided heating, and produces high-quality images free of concentration or color unevenness on a fixed recording member.

The inventors of the present invention have found, after having extensively studied to solve the above problems, that these problems can be solved in an image forming method which at least includes a one-component development step with a toner and transfer step with an intermediate transfer member, when a developing roller having a diameter of 8 to 15 mm is used for the development step, and the toner has an adherence Fh (nN) to a flat surface satisfying the relation represented by the formula (1) and adherence Fr (mN) among toner particles satisfying the relation represented by the formula (2), achieving the present invention.

$$15 \leqq Fh \leqq 50 \quad (1)$$

$$100 \leqq Fr \leqq 400 \quad (2)$$

More specifically, the image forming method and image forming apparatus of the present invention have the following technical features (1) to (22).

(1) An image forming method including at least a one-component developing with a toner, and transferring with an intermediate transfer member, wherein the developing uses a developing roller having a diameter of 8 to 15 mm, and the toner has an adherence Fh (nN) of the toner to a flat surface satisfying the relation represented by the formula (1) and adherence Fr (mN) among the toner particles satisfying the relation represented by the formula (2):

$$15 \leqq Fh \leqq 50 \quad (1)$$

$$100 \leqq Fr \leqq 400 \quad (2)$$

(2) The image forming method according to item 1, wherein the adherence Fh (nN) of the toner to a flat surface and adherence Fr (mN) among the toner particles satisfy the relations of the formulae (3) and (4).

$$1590.5 \times 10^{-0.1103Fh} \leqq Fr \leqq 6338.9 \times 10^{-0.692Fh} \quad (3)$$

$$4Fh \leqq Fr \leqq 4Fh + 240 \quad (4)$$

(3) The image forming method according to any one of items (1) and (2), wherein the toner has a volume-average particle diameter of 3 μm or more and 7 μm or less.

(4) The image forming method according to any one of items (1) to (3), wherein a product of volume-average particle size (Dv, μm) of the toner and external additive content (G, %) of the toner is in a range from 5 or more and 21 or less.

(5) The image forming method according to any one of items (1) to (4), wherein the toner contains at least a binder resin, a colorant and a releasing agent.

(6) The image forming method according to item 5, wherein the binder resin contains at least a polyester-based resin.

(7) The image forming method according to item 6, wherein the polyester-based resin has a glass transition temperature of 40° C. or higher.

(8) The image forming method according to any one of items (5) to (7), wherein the releasing agent contains at least one compound selected from the group consisting of paraffins, synthetic esters, polyolefins, carnauba wax and rice wax, and the toner contains the releasing agent at 3% by weight or more and 30% by weight or less.

(9) The image forming method according to any one of items (1) to (8), wherein the toner has an average circularity of 0.96 or more.

(10) The image forming method according to any one of items (1) to (9), wherein the toner has a core/shell structure.

(11) The image forming method according to any one of items (1) to (10), wherein the core/shell structure contains a vinyl-based copolymer in the shell.

(12) An image forming apparatus composed of at least a developing unit for one-component development with a toner, and a transferring unit with an intermediate transfer member, wherein the developing unit is equipped with a developing roller having a diameter of 8 mm to 15 mm, and the toner has an adherence Fh (nN) of the toner to a flat surface satisfying the relation represented by the formula (1) and adherence Fr (mN) among the toner particles satisfying the relation represented by the formula (2):

$$15 \leqq Fh \leqq 50 \quad (1)$$

$$100 \leqq Fr \leqq 400 \quad (2)$$

(13) The image forming apparatus according to item 12, wherein the adherence Fh (nN) of the toner to a flat surface and adherence Fr (mN) among the toner particles satisfy the relations of the formulae (3) and (4.)

$$1590.5 \times 10^{-0.1103Fh} \leqq Fr \leqq 6338.9 \times 10^{-0.692Fh} \quad (3)$$

$$4Fh \leqq Fr \leqq 4Fh + 240 \quad (4)$$

(14) The image forming apparatus according to any one of items (12) and (13), wherein the toner has a volume-average particle diameter of 3 μm or more and 7 μm or less.

(15) The image forming apparatus according to any one of items (12) to (14), wherein a product of volume-average particle size (Dv, μm) of the toner and external additive content (G, %) of the toner is in a range from 5 or more and 21 or less.

(16) The image forming apparatus according to any one of items (12) to (15), wherein the toner contains at least with a binder resin, a colorant and a releasing agent.

(17) The image forming apparatus according to item (16), wherein the binder resin contains at least a polyester-based resin.

(18) The image forming apparatus according to item (17), wherein the polyester-based resin has a glass transition temperature of 40° C. or higher.

(19) The image forming apparatus according to any one of items (16) to (18), wherein the releasing agent contains at least one compound selected from the group consisting of paraffins, synthetic esters, polyolefins, carnauba wax and rice wax, and the toner contains the releasing agent at 3% by weight or more and 30% by weight or less.

(20) The image forming apparatus according to any one of items (12) to (19), wherein the toner has an average circularity of 0.96 or more.

(21) The image forming apparatus according to any one of items (12) to (20), wherein the toner has a core/shell structure.

(22) The image forming apparatus according to any one of items (12) to (21), wherein the core/shell structure contains a vinyl-based copolymer in the shell.

The present invention can provide an image forming method and image forming apparatus which secure stable toner transferability, prevent reverse transfer of toner back to a latent image bearing member, keep excellent fixing ability and give images of excellent quality.

DETAILED DESCRIPTION OF THE INVENTION

Figure 1:
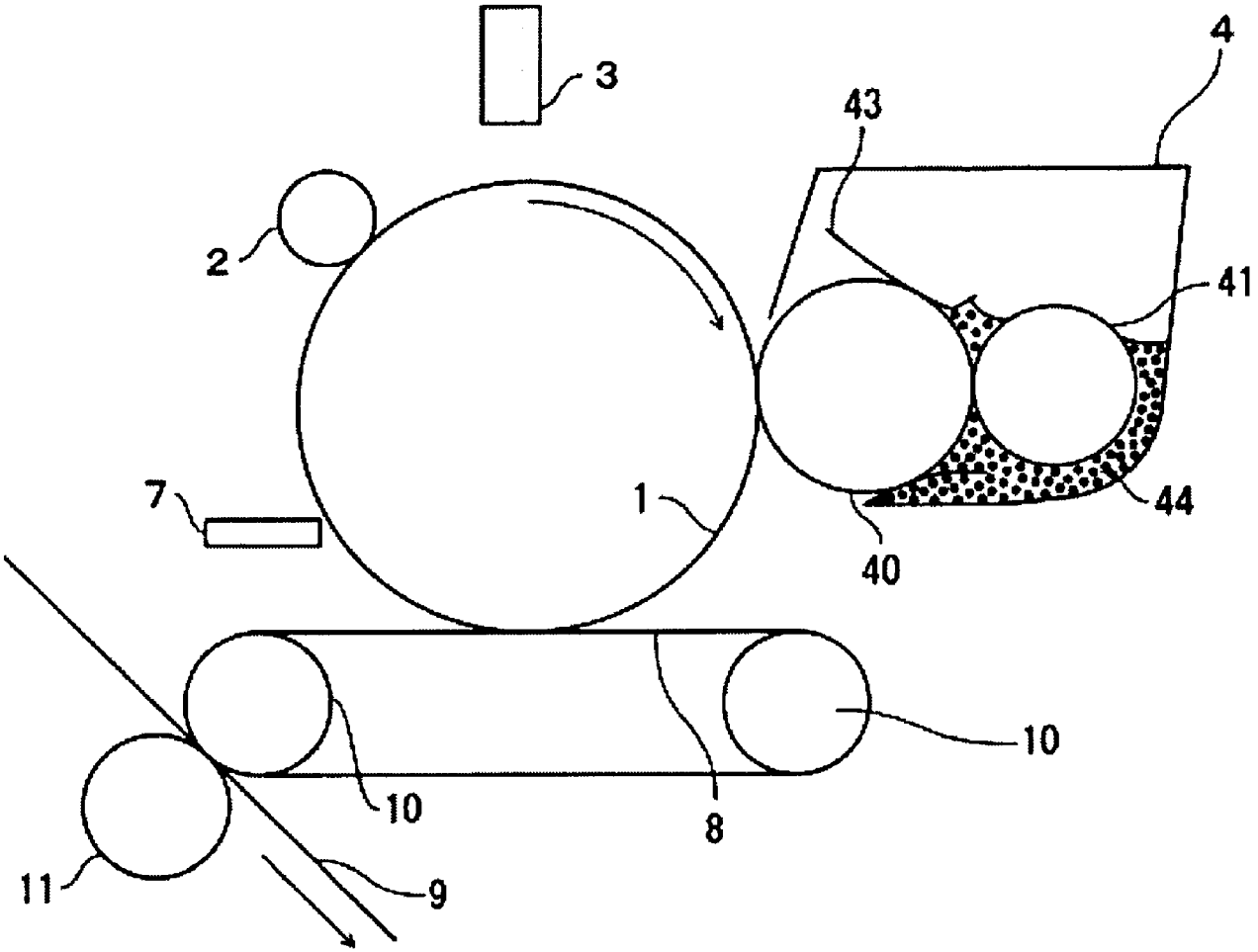
FIG. 1 is a schematic diagram showing a structure of one embodiment of image forming apparatus of the present invention.

The present invention provides an image forming method including a developing step in which developing is performed using a toner by a one-component development method and a transferring step using an intermediate transfer member, wherein the developing step uses a developing roller having a diameter of 8 mm to 15 mm, and the toner has an adherence Fh (nN) to a flat surface satisfying the relation represented by the following formula (1) and an adherence Fr (mN) among toner particles satisfying the relation represented by the following formula (2), and also provides an image forming apparatus for the above method.

$$15 \leqq Fh \leqq 50 \quad (1)$$

$$100 \leqq Fr \leqq 400 \quad (2)$$

<Image Forming Apparatus and Image Forming Method>

One embodiment of image forming apparatus of the present invention is described below in detail by referring to the attached drawings.

FIG. 1 is a schematic diagram showing one example of image forming apparatus of the present invention. An image bearing member 1 is charged by a charging unit 2, and exposed by an exposing unit 3 to form latent images thereon. A bias is applied to a developing roller 40 and the image bearing member 1, and formed latent images are developed and visualized at a contact part with a developer 44. The developer 44 is supplied by a supply roller 41, and formed into a thin film on the developing roller 40 by a restriction blade 43. The developer 44 developed and visualized as the latent images are transferred onto an intermediate transfer member (intermediate transfer belt) 8, then transferred onto a recording medium (transfer medium) 9, e.g., paper, held between transfer rollers 11, and fixed on the recording medium 9 by a heat fixing roller (not shown). The developer 44 not transferred to the intermediate transfer member 8 and remaining on the image bearing member 1 is recovered by a cleaning member 7 to be discarded.

<Charging Unit>

For the charging unit 2, a corotron device, scorotron device, solid discharging element, needle electrode device, roller charging device or electroconductive brush device, etc. is used and known methods for charging are available.

<Exposing Unit>

For the exposing unit 3, common light-emitting devices, e.g., fluorescent lamp, tungsten lamp, halogen lamp, mercury lamp, sodium lamp, light-emitting diode (LED), semiconductor laser (LD) and electroluminescent (EL) devices may be used. It may be equipped with various filters for selectively emitting light in a desired wavelength range. Examples of such filters include, sharp-cut filters, hand pass filters, near-infrared-light-cutting filters, dichroic filters, interference filters and color conversion filters.

<Developing Unit>

Figure 2:
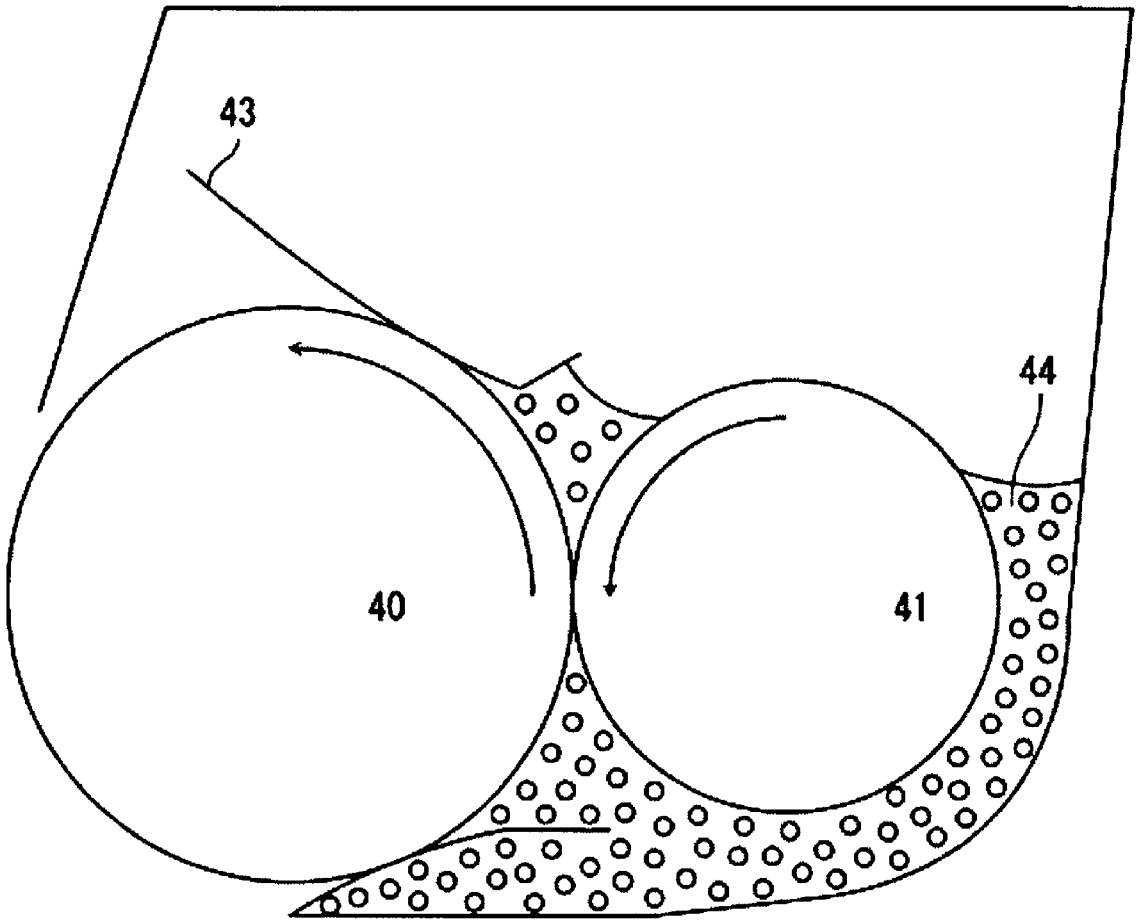
FIG. 2 is a schematic diagram showing a part of structure of one embodiment of image forming apparatus of the present invention.

FIG. 2 is a schematic diagram showing a developing unit (process cartridge) used for the embodiment. The developer (toner) 44 in the developing unit is sent to a nip between the developing roller 40 and supply roller 41, while being stirred by the latter. A thin toner film is formed on the developing roller 40, while its toner quantity is restricted by the restriction blade 43. Moreover, the toner is rubbed at the nip between the supply roller 41 and developing roller 40, and also between the restriction blade 43 and developing roller 40 to be charged adequately for developing. The undeveloped toner recovered in the developing unit 4 by the developing roller 40 is scraped off by the supply roller 41 for reuse for development.

The developing roller 40 preferably has a diameter of 8 mm to 15 mm, more preferably 10 mm to 12 mm.

Materials for the developing roller 40, supply roller 41 and restriction blade 43 may be adequately selected from those known suitable for one-component development methods.

<Cleaning Unit>

For the cleaning units a fur brush and cleaning blade are used. A pre-cleaning charger may be used for more efficient cleaning. For cleaning units, other units including units using a web type method, magnet brush type method or the like may be appropriately applied. These units may be used either alone or in combination of two or more.

In an image forming apparatus which adopts a cleaner-less process, the toner not transferred to the intermediate transfer member 8 and remaining on the image bearing member is recovered in the developing unit 4 by the developing roller 40 and scraped off by the supply roller 41 for reuse. The toner recovered by the developing roller 40 should be sufficiently scraped off by the supply roller 41, in particular in a cleaner-less process, because it is considered that the recovered residual toner, which is not transferred to the intermediate transfer member 8, is greatly out of a suitable charge range.

Printers with a one-component developing device, which is advantageous for reducing printer size, are strongly demanded to be smaller, viewed from space-saving of a printer and increased freedom of setting. Each component in the developing device is also required to be smaller, as toner transfer mechanisms in the developing devices become smaller. However, decreasing size of each component in the developing device causes following problems.

Decreasing diameters of a developing and toner supply rollers, the former for developing toner on an image bearing member and the latter for supplying a toner to the developing roller, will decrease toner supply rate, with the result that the developing device may have insufficient toner followability and produce images of uneven concentration. This problem resulting from decreased developing roller diameter to cause insufficient toner followability is more pronounced when toner particles are made smaller, still more pronounced in toners incorporated with a releasing agent, e.g., wax.

Insufficient toner followability, resulting from decreased developing roller diameter is conceivably caused by decrease in the circumferential length as the diameter of developing roller decreases, which needs increased roller rotation speed to secure a toner supply rate for development. Moreover, decreased developing roller diameter decreases roller curvature radius to prevent attachment of a toner to the developing roller surface, which is also considered as one of reasons for insufficient toner followability.

The followability, degraded as developing roller diameter decreases, can be improved by controlling toner adherence Fh to a flat surface.

Use of a cleaner-less photoconductor drum is one of the measures for decreasing size of an image forming apparatus which forms multi-color images by bringing toner images developed on a latent image bearing member, e.g., photoconductor drum, into contact with a transfer medium, e.g., transfer paper, intermediate transfer member or the like, superimposing them one on another. Such a cleaner-less photoconductor drum can contribute to space-saving, because it can dispense with a cleaning blade mechanism. However, it tends to cause reverse transfer in a transfer step for forming multi-color images, in which a toner image is transferred from the transfer medium back to the latent image bearing member while a subsequent image is transferred, resulting in color contamination and degraded quality of multi-color images. The reverse transfer is conceivably caused by insufficient adherence of a toner to an intermediate transfer member surface onto which it is transferred, tending to move from the medium surface back to the latent image bearing member in the subsequent contact-transfer step, because it cannot be fast retained on the surface. The reverse transfer can be prevented by keeping adherence Fh of toner to a flat surface at 15 nN or more.

<Process Cartridge>

The image forming apparatus of the present invention may be equipped with a process cartridge (developing unit), such as that illustrated in FIG. 2.

Moreover, two or more constituent components, e.g., a photoconductor, a charging unit, a cleaning unit and so forth, may be assembled into a process cartridge as an integrated structure, which can be detachably attached to an image forming apparatus, e.g., copier or printer.

<Toner>

Next, the toner used in this embodiment is described in detail.

The toner for the present invention has an adherence Fh of 15 nN to 50 nN to a flat surface, preferably 15 nN to 40 nN, and adherence Fr among the toner particles of 100 mN to 400 mN, preferably 150 mN to 350 mN. At an Fh level below 15 nN, the toner may not sufficiently adhere to a developing roller of relatively small diameter in one component development, tending to cause various problems, e.g., insufficient toner supply rate, insufficient toner followability and images of uneven concentration which it gives. These problems are more pronounced as toner size decreases. Moreover, it tends to cause reverse transfer, in which a toner image is transferred from a transfer medium, e.g. intermediate transfer belt back to a latent image bearing member, e.g. photoconductor drum, and hence color contamination. At an Fh level above 50 nN, on the other hand, the toner will tend to have degraded developing ability. At an Fr level below 100 mN, the toner particles tend to scatter during the transfer step, when the toner adheres to a roller surface relatively thickly. At an Fr level above 400 mN, on the other hand, the toner will have degraded transfer efficiency during the transfer step, tending to cause falling-off of the images when it adheres to a roller surface relatively thickly. Images of uneven concentration, falling-off and color contamination can be avoided by controlling such toner characteristics.

(Toner Adherence Fh to a Flat Surface)

Figure 3:
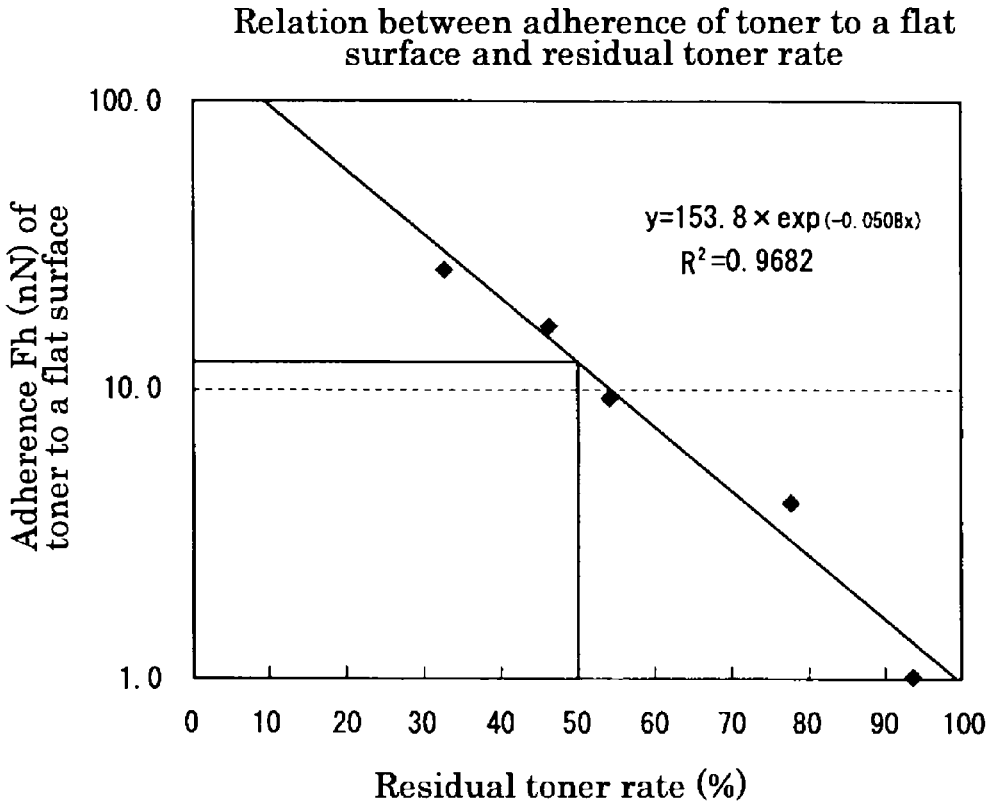
FIG. 3 gives a graph illustrating one example of relation between adherence of toner Fh to a flat surface and residual toner rate (adherence Fr among toner particles)
Figure 4:
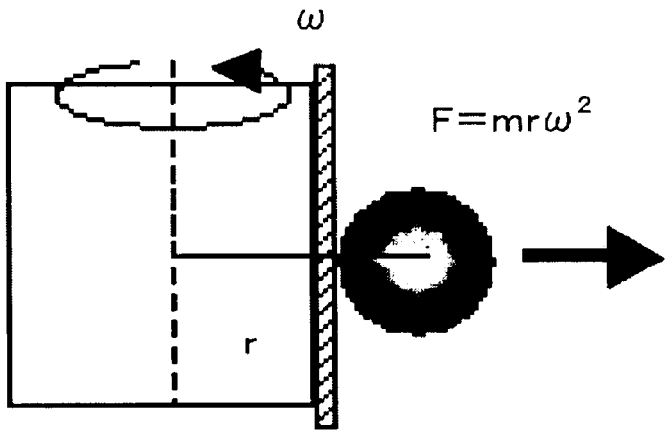
FIG. 4 is a diagram of a device for determining toner adherence to a flat surface.

Toner adherence Fh to a flat surface in this embodiment is determined using a centrifugal adherence tester (NS-C100, Nanoseeds), in which the toner particles adhering to a flat surface is centrifugally separated and a separating force at which 50% of the particles are separated is taken as a 50% adherence. FIG. 3 illustrates one example of the relation between toner residual rate and adherence, and FIG. 4 conceptually illustrates the tester for determining toner adherence to a flat surface.

More specifically, a slide glass plate to which a toner adheres is set in a high-speed centrifugal separator on a sample cell, and rotated at 5 speed levels of 2,000 rpm, 4,000 rpm, 6,000 rpm, 12,000 rpm and 16,000 rpm to record the toner separation conditions. The separating force on the toner is calculated from toner true specific gravity, particle diameter, rotating speed, and rotation radius. The toner residual rate based on the initial toner quantity attached is measured, to plot separating force at a vertical axis against the residual rate at a horizontal axis. The data are approximated by a straight line to determine a separating force at which 50% of the toner is separated to obtain an adherence. The separating force is taken as an adherence. The tests are carried out at 23° C. and 50% RH.

Adherence Fh of the toner to a flat surface is determined by the following procedure. Angular speed ω at which toner particle residual rate R reaches 50% is determined by the above procedure to determine a 50% adherence by the following formula (5):

$$Fh=(\pi/6)\cdot\rho\cdot d^3\cdot r\cdot\omega^2 \quad (5)$$

wherein, ρ is toner particle intrinsic density, d is particle diameter, r is rotation radius and ω is angular speed at which 50% of the toner is separated.

The analyzer to determine toner adherence Fh to a flat surface is not limited to the above, so long as it works on the same principle.

(Adherence Fr Among Toner Particles)

Adherence Fr among the toner particles in this embodiment is determined by a powder compressive/tensile characteristics analyzer (Agrobot, Hosokawa Micron), in which 5 g of powder is put in a cylindrical cell (inner diameter: 25 mm) divided into two sections in the vertical direction, held there at a compressive force of 8 kg at 25° C., and subjected to a tensile force by lifting the upper cell upwards. The maximum force at which the toner layer is fractured is taken as adherence Fr. The test conditions are spring wire diameter: 1 mm, compression speed: 0.02 mm/second, compression holding time: 300 seconds, and tensile speed: 0.6 mm/second.

The analyzer to determine adherence Fr of the toner particles to each other is not limited to the above, so long as it works on the same principle.

Adherence Fh of the toner to a flat surface and adherence Fr among the toner particles in this embodiment preferably satisfy the relations of the following formulae 3 and 4.

$$1590.5\times10^{-0.1103Fh}\leqq Fr\leqq 6338.9\times10^{-0.692Fh} \quad (3)$$

$$4Fh\leqq Fr\leqq 4Fh+240 \quad (4)$$

When the formula (3) relation is satisfied, toner followability can be secured without sacrificing toner transfer rate even when a developing roller has a relatively small diameter, to prevent concentration unevenness of the images. Moreover, reverse transfer, in which a toner is transferred from a transfer medium, e.g., intermediate transfer belt, back to a latent image bearing member, e.g., photoconductor drum, can be prevented, to prevent color contamination of the images. When the formula (4) relation is satisfied, scattering and image falling-off can be prevented during the transfer step even when a relatively large quantity of toner adheres.

Figure 5:
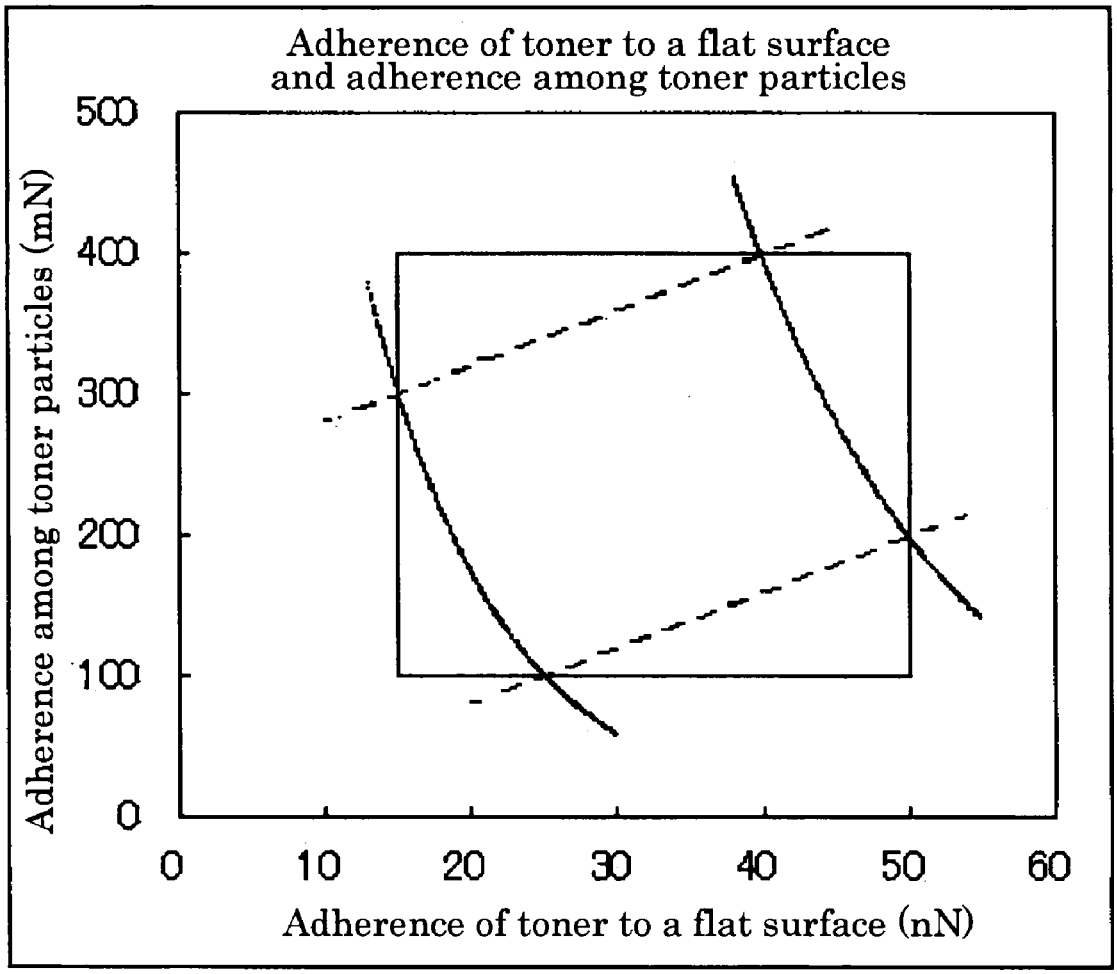
FIG. 5 is a graph illustrating a relation between adherence among toner particles and toner adherence to a flat surface.

FIG. 5 is a graph showing the relation between adherence of the toner to a flat surface and adherence among the toner particles for the present invention.

In this embodiment, adherence Fh of the toner to a flat surface and adherence Fr among the toner particles preferably satisfy the corresponding formulae (1) to (4) relations. The suitable relations between Fh and Fr are illustrated in FIG. 5, where the region in which the formulae (1) and (2) relations are satisfied is defined by the solid frame, and the region in which the formulae (3) and (4) relations are satisfied is defined by the solid and broken curves.

The toner falling into the region in which these relations are satisfied, can provide an image forming method and an image forming apparatus which has particularly stable toner transferability, prevents its reverse transfer back to a latent image bearing member, has excellent fixing ability, and produces high-quality images.

The toner for the present invention preferably has a volume-average particle diameter of 3 μm to 7 μm, more preferably 4 μm to 6 μm. When it is smaller than 3 μm, the toner may cause problems in each of the image-forming processes. When it is larger than 7 μm, on the other hand, the toner may give an image of insufficient resolution.

The toner for the present invention preferably has an average circularity of 0.96 or more. The toner having an average circularity below 0.96 may cause insufficient transfer.

The toner for the present invention preferably contains a binder resin, colorant and releasing agent, more preferably an external additive. An external additive can help improve flowability, developing ability and transferability of the toner.

The binder resin preferably contains a polyester-based resin, which preferably has a glass transition temperature of 40° C. or higher, more preferably 45° C. or higher.

The product of volume-average particle size of the toner and external additive content of the toner is preferably in a range from 5 to 21 μm×% by mass. The toner may have degraded transferability and cause image falling-off when it is below 5 μm×% by mass, which is more pronounced when full-color images are produced or the toner contains a releasing agent. When it is above 21 μm×% by mass, on the other hand, the toner may have degraded fixing ability to give images of insufficient fixing strength. The toner of the present invention tends to lose fixing ability, in particular when it is used in an image forming apparatus with a fixing unit which employs no oil-aided heating.

Toner transferability as used in the present invention means easiness of the toner image formed on a photoconductor being transferred onto a transfer medium. The term includes, when a toner image on a photoconductor is transferred onto an intermediate transfer member, e.g., intermediate transfer belt, and then onto a transfer medium, easiness of transfer in the both steps.

The toner for the present invention preferably has a core/shell structure. One example of such a structure has a colorant, releasing agent and binder resin (A) serving as the core, which is coated with another binder resin (B) as the shell. The binder resin (A) preferably contains a polyester-based resin as a major ingredient, whereas binder resin (B) is preferably a vinyl-based copolymer. In other words, the core as a major component of the toner contains a polyester-based resin, which is advantageous for simultaneously improving fixing ability at low temperature and heat-resistance storage stability, and the shell which has a major effect on toner electrostatic chargeability contains a vinyl-based copolymer, which is advantageous for controlling toner electrostatic chargeability.

Adherence of the toner for the present invention to a flat surface can be controlled by mass ration of the toner resin compositions and resin molecular weights.

More specifically, the toner can have a controlled adherence to a flat surface by incorporating a polyester resin as a major ingredient of the core with a polyester resin of relatively high molecular weight after it is modified to have urethane or urea group and controlling content of the modified polyester resin; increasing the content can decrease the adherence. The adherence can be set at an adequate level by controlling the modified resin content at 10 to 20%.

Adherence of the toner to a flat surface can be also controlled by controlling weight-average molecular weight of the polyester resin; increasing the molecular weight can decrease the adherence. The adherence to a flat surface can be set at an adequate level by controlling the weight average molecular weight at about 8,000 to 15,000.

Adhesion of the toner to a flat surface can be also controlled by resin composition of the shells on the toner surfaces and core/shell ratio by weight. The monomer composition for the resin which constitutes the shells preferably contains an acidic component at 5% by mass or more. Such a composition will increase the adherence to a flat surface and keep it at an adequate level. The shell/core weight ratio is preferably 0.05 or more by weight, because the adherence tends to decrease as the ratio goes below 0.05.

Adhesion among the toner particles for the present invention can be controlled by toner particle shape and shell/core weight ratio. The toner particles having a higher circularity tend to have a better flowability, hence move more freely under pressure, are more resistant to plastic deformation while coming into contact with one another, and have an adhesion to one another at a relatively low level. Increasing the shell/core weight ratio to 0.05 or more can keep the adherence at a relatively high level by the effects of the shell resin. The weight ratio is preferably in a range from 0.05 to 0.5, more preferably 0.07 to 0.4, particularly preferably 0.1 to 0.3. At a weight ratio below 0.05, the effects of the shell resin may be insufficient. At a weight ratio above 0.5, on the other hand, the effects of the core resin may be insufficient.

The shell of the core/shell structure can cushion pressure on the structure during the development step with a developing roller of relatively small diameter, in particular in one-component development, thereby preventing cracking and/or deformation of the toner particles.

The toner composition is described in more detail.

Figure 6:
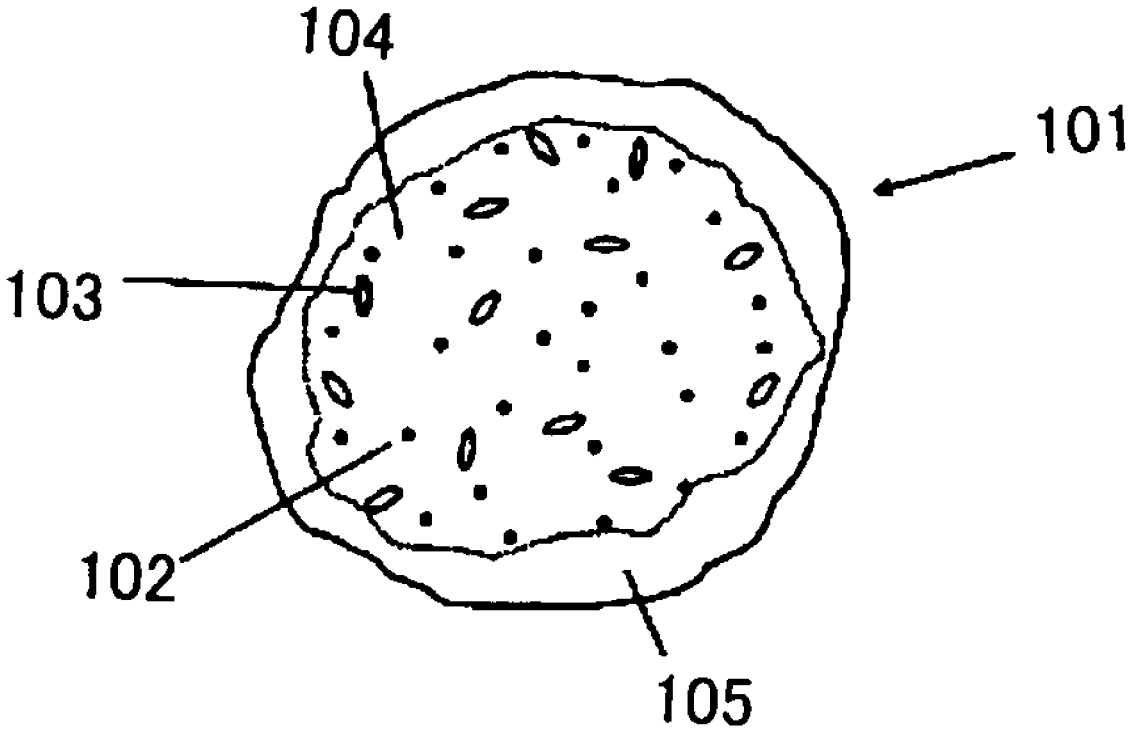
FIG. 6 is a schematic diagram showing a structure of toner used for the present invention.

FIG. 6 schematically illustrates the toner particle structure of the present invention.

As illustrated in FIG. 6, a toner particle 101 of the present invention has a core 104 and shell 105, the former containing a colorant 102, releasing agent 103 and binder resin (A) while the latter containing the binder resin (B) covering the core. The binder resin (A) contains a polyester resin as a major ingredient while the binder resin (B) is a vinyl-based copolymer resin. In other words, the core as a major component of the toner contains a polyester resin, which is advantageous for simultaneously improving fixing ability at low temperature and heat-resistance/storage stability as property as a resin itself, and the shell, which constitute a toner surface and has a major effect on toner electrostatic chargeability, is a vinyl-based copolymer resin, which is advantageous for controlling toner electrostatic chargeability.

A vinyl-based copolymer resin is advantageous for controlling electrostatic chargeability for the following reasons: (1) it can be polymerized by two or more types of monomers which can be selected from a wide range of compounds, and also can easily incorporate a polar group, e.g., carboxylic acid or sulfonic acid, and (2) it can be structurally formed within the polymer particles utilizing monomer polarity, e.g., in emulsion or suspension polymerization, to efficiently have a functional group derived from a desired monomer selectively on the particle surfaces.

Hence, the above composition realizes the toner good in fixing characteristics, e.g., fixing ability at low temperature, and developing ability and transferability, which depend on electrostatic chargeability. The shell/core weight ratio is preferably in a range from 0.05 to 0.5, more preferably 0.07 to 0.4, particularly preferably 0.1 to 0.3. At a weight ratio below 0.05, the effects of a binder resin (B) of vinyl-based copolymer resin may be insufficient. At a weight ratio above 0.5, on the other hand, the toner may have degraded fixing characteristics because of insufficient quantity of binder resin (A) of polyester resin.

The toner for the present invention preferably has a softening point (Tm) of 115° C. to 140° C. When it is below 115° C., the toner may be difficult to sufficiently secure compressive strength, and also may have degraded fixing/separation ability in a fixing process which dispenses with oil-aided heating. When it is above 140° C., on the other hand, the toner may have degraded fixing ability.

The toner for the present invention preferably satisfies the following relations in order to further enhance the effects of the core/shell structure:

RA (P)×0.5>RB (P), and RA (W)×0.5>RB(W), more preferably

RA (P)×0.2>RB (P), and RA (W)×0.2>RB(W), and still more preferably

RA (P)×0.01>RB (P), and RA (W)×0.01>RB(W), wherein, RA (P): content of colorant in the core based on the core, RA (W): content of releasing agent in the core based on the core, RB (P): content of colorant in the shell based on the shell and RB (W): content of releasing agent in the shell based on the shell.

In other words, it is desirable that the colorant and releasing agent are present at a low content in the vicinity of the toner particle surfaces and are not exposed. This structure prevents adverse effects of the releasing agent on a photoconductor, e.g., filming; gives an electrostatic chargeability excellent in resistance to environment, and minimizes difference of electrostatic chargeability resulting from different colorants in a full-color toner.

<Polyester Resin>

The type of the polyester resin for the present invention is not particularly limited, and any types can be used. Moreover, it may be composed of two or more types. For example, polycondensates of polyol (1) and polycarboxylic acid (2), described below, may be used as the polyester resins.

(Polyols)

The polyol (1) includes alkylene glycols, e.g., ethylene glycol 1,2-propylene glycol, 1,3-propylene glycol 1,4-butanediol, 1,6-hexanediol and so forth; alkylene ether glycol e.g., diethylene glycol triethylene glycol, dipropylene glycol polyethylene glycol, polypropylene glycol polytetramethylene ether glycol and the like; alicyclic diols, e.g., 1,4-cyclohexane dimethanol, hydrogenated bisphenol A and the like; bisphenols, e.g., bisphenol A, bisphenol F, bisphenol S, 4,4'-dihydroxybiphenyls (e.g., 3,3'-difluoro-4,4'-dihydroxybiphenyl and the like); bis(hydroxyphenyl)alkanes, e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (or tetrafluorobisphenol A), 2,2-bis(3-hydroxyphenyl)-1,1,1,3,3,3-hexafluoropropane and the like;

bis(4-hydroxyphenyl)ethers and the like, e.g., bis(3-fluoro-4-hydroxyphenyl)ether and the like; adducts of the above-described alicyclic diols with an alkylene oxide (e.g., ethylene oxide, propylene oxide, butylenes oxide or the like); and adducts of the above-described bisphenols with an alkylene oxide (e.g., ethylene oxide, propylene oxide, butylenes oxide or the like).

Of these compounds, those more preferable are alkylene glycols of 2 to 12 carbon atoms, and adducts of bisphenols with an alkylene oxide, and those particularly preferable are combinations of adducts of bisphenols with an alkylene oxide and alkylene glycols of 2 to 12 carbon atoms.

The other polyol (1) includes polyhydric aliphatic alcohols having a valence of 3 to 8 or more, e.g., glycerin, trimethylol ethane, trimethylol propane, pentaerythritol sorbitol and the like; trivalent or higher phenols, e.g., trisphenol PA, phenol novolac, cresol novolac and the like; and alkylene oxide adducts of a trivalent or higher polyphenols.

These polyols may be used either alone or in combination of two or more kinds, and are not limited to the above.

(Polycarboxylic Acids)

The polycarboxylic acid (2) includes alkylene dicarboxylic acids, e.g., succinic acid, adipic acid, sebacic acid and the like; and alkyenylene dicarboxylic acids, e.g., maleic acid, fumaric acid and the like); aromatic dicarboxylic acids, e.g., phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidenediphthalic anhydride, and the like.

Of these compounds, those preferable are alkyneylene dicarboxylic acids of 4 carbon atoms to 20 carbon atoms, and aromatic dicarboxylic acids of 8 carbon atoms to 20 carbon atoms. Moreover, trivalent or higher polycarboxylic acids include aromatic polycarboxylic acids of 9 carbon atoms to 20 carbon atoms, e.g., trimellitic acid, pyromellitic acid and the like. The polycarboxylic acid (2) anhydride or a lower alkyl ester e.g. methyl ester, ethyl ester, isopropyl ester and the like thereof may be reacted with the polyol (1).

These polycarboxylic acids may be used either alone or in combination of two or more kinds, and are not limited to the above.

(Polyol/Polycarboxylic Acid Ratio)

The polyol (1)/polycarboxylic acid (2) ratio is generally in a range from 2/1 to 1/1 as the hydroxyl group [OH]/carboxylic group [COOH] equivalent ratio, preferably 1.5/1 to 1/1, more preferably 1.3/1 to 1.02/1.

(Molecular Weight of Polyester Resin)

The polyester resin generally has a peak molecular weight of 1,000 to 30,000, preferably 1,500 to 10,000, still more preferably 2,000 to 8,000. The resin having a peak molecular weight below 1,000 may have degraded heat-resistance/storage stability. The resin having a peak molecular weight above 30,000, on the other hand, may have degraded fixing ability at low temperature.

<Vinyl-Based Copolymer Resin>

Types of the vinyl-based copolymer resin for the present invention are not particularly limited, and any types can be used. Moreover, it may be a mixture of two or more types.

A vinyl-based copolymer resin is a polymer in which vinyl-based monomers are copolymerized. The vinyl-based monomer includes the following types (1) to (10).

(1) Vinyl-Based Hydrocarbons

Aliphatic vinyl-based hydrocarbons: alkenes, e.g., ethylene, propylene, butene, isobutylene, pentene, heptene, diisobutylene, octene, dodecene, octadecene, and α-olefins other than the above; and alkadienes, e.g., butadiene, isoprene, 1,4-pentadiene, 1,6-hexadiene and 1,7-octadiene.

Alicyclic vinyl-based hydrocarbons: mono- or di-cycloalkene, and alkadienes, e.g., cyclohexene, (di)-cyclopentadiene, vinyl cyclohexene and ethylidene bicycloheptene; and terpenes, e.g., pinene, limonene and indene.

Aromatic vinyl-based hydrocarbons, e.g., styrene and its hydrocarbyl (alkyl cycloalkyl, aralkyl and/or alkenyl) substitutes, e.g., α-methylstyrene, vinyl toluene, 2,4-dimethylstyrene, ethylstyrene, isopropylstyrene, butylstyrene, phenylstyrene, cyclohexylstyrene, benzylstyrene, crotylstyrene, divinyl benzene, divinyl toluene, divinyl xylene and trivinyl benzene; and vinyl naphthalene.

(2) Vinyl-Based Monomers Containing Carboxyl Group and Salts Thereof

Unsaturated monocarboxylic acids, unsaturated dicarboxylic acids, and anhydrides thereof and their monoalkyl (carbon atom number: 1 to 24) esters, where carboxylic acids have 3 to 30 carbon atoms, e.g., vinyl-based monomers containing a carboxyl group, such as (meth)acrylic acid, (anhydrous)maleic acid, maleic acid monoalkyl esters, fumaric acid, fumaric acid monoalkyl esters, crotonic acid, itaconic acid, itaconic acid monoalkyl esters, itaconic acid glycol monoethers, citraconic aid, citraconic acid monoalkyl esters and cinnamic acid.

(3) Vinyl-Based Monomers Containing Sulfonate Group, Vinyl-Based Monoesterified Sulfuric Acid, and Salts Thereof.

Alkene sulfonic acids of 2 to 14 carbon atoms, e.g., vinyl sulfonic acid, (meth)acrylsulfonic adic, methyl vinyl sulfonic acid, styrene sulfonic acid, alkyl derivatives of styrene sulfonic adic having 2 to 24 carbon atoms (e.g., α-methylstyrene sulfonic adic); and sulfo(hydroxyl)alkyl-(meth)acrylate or (meth)acrylamide, e.g., sulfopropyl (meth)acrylate, 2-hydroxy-3-(meth)acryloxypropyl sulfonate, 2-(meth)acryloyl amino-2,2-dimethylethane sulfonic adic, 2-(meth)acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl (carbon atom number: 3 to 18) allyl sulfosuccinic acids, sulfuric esters of poly-(n=2 to 30) oxyalkylene(ethylene, propylene and butylene, which may be alone or random or block) mono-(meth)acrylates [e.g., sulfuric acid esters of poly-(n=5 to 15)oxypropylene monomethacrylate] and sulfuric acid esters of polyoxyethylene polycyclic phenyl ethers.

(4) Vinyl-Based Monomers Containing Phosphate Group and Salts Thereof.

(meth)acryloyloxy alkyl phosphate monoesters, 2-hydroxyethyl(meth)acryloyl phosphate, phenyl-2-acryloyloxyethyl phosphate, (meth)acryloyloxy alkyl (carbon atom number: 1 to 24) phosphonic acid e.g. 2-acryloyloxy ethyl phosphonic acid; and salts thereof.

The salts in (2) to (4) include, for example, alkaline metal (e.g., sodium and potassium) salts, alkali-earth metal (e.g., calcium and magnesium) salts, ammonium salts, amine salts and quaternary ammonium salts.

(5) Vinyl-Based Monomers Containing Hydroxyl Group:

Hydroxystyrene, N-methylol(meth)acrylamide, hydroxyethyl(meth)acrylate, hydroxypropyl(meth)acrylate, polyethylene glycol mono(meth)acrylate, (meth)allyl alcohol crotyl alcohol ispocrotyl alcohol 1-butene-3-ol, 2-butene-1-ol, 2-butene-1,4-diol, propargyl alcohol, 2-hydroxyethylpropenyl ether, saccharose allyl ether and so forth.

(6) Vinyl-Based Monomers Containing Nitrogen:

Vinyl-based monomers containing amino group, e.g., aminoethyl(meth)acrylate, dimethylaminoethyl(meth)acrylate, diethylaminoethyl(meth)acrylate, t-butylaminoethyl methacrylate, N-aminoethyl(meth)acrylamide, (meth)allylamine, morpholinoethyl(meth)acrylate, 4-vinyl pyridine, 2-vinyl pyridine, crotylamine, N,N-dimethylaminostyrene, methyl-α-acetoaminoacrylate, vinyl imidazole, N-vinylpyrrole N-vinyl thiopyrrolidone, N-arylphenylenediamine, ammocarbazole, aminothiazole, aminoindole, aminopyrrol, aminoimidazole, aminomercaptothiazole, and salts thereof.

Vinyl-based monomers containing amide group: (meth) acrylamide, N-methyl(meth)acrylamide, N-butylacrylamide, diacetone acrylamide, N-methylol(meth)acrylamide, N,N-methylene-bis(meth)acrylamide, amide cynnamate, N,N-dimethyl acrylamide, N,N-dibenzyl acrylamide, methacryl formamide, N-methyl-N-vinyl acetoamide, N-vinyl pyrrolidone, and so forth.

Vinyl-based monomers containing nitrile group: (meth) acrylonitrile, cyanostyrene, cyanoacrylate and so forth.

Vinyl-based monomer containing quaternary ammonium cation group: vinyl-based monomers containing tertiary amine group, e.g., dimethylaminoethyl(meth)acrylate, diethylaminoethyl(meth)acrylate, dimethylaminoethyl (meth)acrylamide, diethylaminoethyl(meth)acrylamide, diallylamine, quarternized with a quaternizing agent, e.g., methyl chloride, dimethyl sulfate, benzyl chloride, dimethyl carbonate or the like.

Vinyl-based monomers containing nitro group: nitrostyrene and the like.

(7) Vinyl-Based Monomers Containing Epoxy Group

Glycidyl(meth)acrylate, tetrahydrofurfuryl(meth)acrylate, p-vinyl phenylphenyl oxide and so forth.

(8) Vinyl Esters, Vinyl(thio)ethers, Vinyl Ketones and Vinyl Sulfones:

Vinyl esters, e.g., vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinyl methoxy acetate, vinyl benzoate, ethyl-α-ethoxy acrylate; alkyl(meth)acrylates having an alkyl group of 1 to 50 carbon atoms [e.g., methyl(meth)acrylate, ethyl(meth)acrylate, propyl(meth)acrylate, butyl(meth)acrylate, 2-ethylhexyl (meth)acrylate, dodecyl(meth)acrylate, hexadecyl(meth) acrylate, heptadecyl(meth)acrylate and eicosyl(meth) acrylate]; dialkyl fumarates (two alkyl groups are a linear, branched or alicyclic group of 2 to 8 carbon atoms), dialkyl maleates (two alkyl groups are a linear, branched or alicyclic group of 2 to 8 carbon atoms); poly(meth)allyloxyalkanes [e.g., diallyloxyethane, triallyloxyethane, tetraallyloxyethane, tetraallyloxypropane, tetraallyloxybutane and tetrametaallyloxyethane]; vinyl-based monomers having a polyalkylene glycol chain [e.g., polyethylene glycol (molecular weight: 300) mono(meth)acrylate, polypropylene glycol (molecular weight: 500) monoacrylate, adduct of (meth)acrylate with 10 mol of methyl alcohol ethylene oxide, and adduct of (meth)acrylate with 30 mol of lauryl alcohol ethylene oxide]; poly-(meth)acrylates [e.g., poly-(meth)acrylates of polyhydric alcohols: ethylene glycol di(meth)acrylate, propylene glycol di(meth)acrylate, neopentyl glycol di(meth)acrylate, trimethylol propane tri(meth)acrylate and polyethylene glycol di(meth)acrylate]. Vinyl(thio)ethers, e.g., vinyl methyl ether, vinyl ethyl ether, vinyl propyl ether, vinyl butyl ether, vinyl-2-ethylhexyl ether, vinyl phenyl ether, vinyl-2-methoxyethyl ether, methoxybutadiene, vinyl-2-butoxyethyl ether, 3,4-dihydro-1,2-pyrane, 2-butoxy-2'-vinyloxydiethyl ether, vinyl-2-ethylmercaptoethyl ether, acetoxystyrene and phenoxystyrene. Vinyl ketones, e.g., vinyl methyl ketone, vinyl ethyl ketone, vinyl phenyl ketone; and vinyl sulfones, e.g., divinyl sulfide, p-vinyl diphenyl sulfide, vinyl ethyl sulfide, vinyl ethyl sulfone, divinyl sulfone, divinyl sulfoxide and so forth.

(9) Other Vinyl-Based Monomers:

Isocyanate ethyl(meth)acrylate, m-isopropenyl-α,α-dimethylbenzyl isocyanate and the like.

(10) Vinyl-Based Monomers Containing Fluorine:

4-fluorostyrene, 2,3,5,6-tetrafluorostyrene, pentafluorophenyl(meth)acrylate, pentafluorobenzyl(meth)acrylate, perfluorocyclohexyl(meth)acrylate, perfluorocyclohexylmethyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,5H-octafluoropentyl(meth) acrylate, 1H,1H,7H-dodecafluoroheptyl(meth)acrylate, perfluorooctyl(meth)acrylate, 2-perfluorooctylethyl(meth) acrylate, heptadecafluorodecyl(meth)acrylate, trihydroperfluoroundecyl(meth)acrylate, perfluoronorbornylmethyl (meth)acrylate, 1H-perfluoroisobornyl(meth)acrylate, 2-(N-butylperfluorooctane sulfonamide)ethyl(meth)acrylate, 2-(N-ethylperfluorooctane sulfonamide)ethyl(meth)acrylate, and the corresponding compounds derived from α-fluoroacrylic acid.

Bis-hexafluoroisopropyl itaconate, bis-hexafluoroisopropyl maleate, bis-perfluorooctyl itaconate, bis-perfluorooctyl maleate and bis-trifluoroethyl itaconate, bis-trifluoroethyl maleate; vinyl heptafluorobutyrate, vinyl perfluoroheptanoate, vinyl perfluorononanoate and vinyl perfluorooctanoate and so forth.

(Vinyl-Based Copolymers)

Vinyl-based copolymers include a polymer produced by copolymerization of two or more of the optionally selected monomers in (1) to (10) described above, being incorporated at optional contents. The examples include styrene-(meth) acrylic acid ester copolymers, styrene-butadiene copolymers, (meth)acrylic acid-acrylic acid ester copolymers, styrene-acrylonitrile copolymers, styrene-maleic acid anhydride copolymers, styrene-(meth)acrylic acid copolymers, styrene-(meth)acrylic acid, divinyl benzene copolymers, and styrene-styrene sulfonic acid-(meth)acrylic acid ester copolymers.

<Fine Particles of Vinyl-Based Copolymer Resin>

The above-described vinyl-based copolymer resin for toner production is preferably in the form of fine particles of vinyl-based copolymer resin dispersed in an aqueous medium. Fine particles of a vinyl-based copolymer resin can be easily produced by common emulsion polymerization or the like. The binder resin (B) for the toner of the present invention is more preferably in the form of fine particles of vinyl-based copolymer resin agglomerated and/or fused. The shell can cover the core leaving less gaps, when it is in the form of agglomerated fine particles, more completely when the particles are fused, to bring various advantages, e.g., smoothened and uniform toner surfaces, stabilized charging distribution and improved transferability.

<Modified Polyester Resin>

The binder resin (A) for the present invention may contain a polyester resin extended by the urethane or/and urea bond for adjusting viscoelasticity and thereby preventing offsetting and so forth (such a polyester may be referred to as a modified polyester resin having the urethane or/and urea group). The modified polyester resin having the urethane or/and urea group is preferably incorporated in the binder resin (A) at 20% or less. At a content above 20%, the binder resin (A) may give a toner of degraded fixing ability at low temperature. At a content below 10%, on the other hand, it may have a degraded compressive strength. The modified polyester resin having the urethane or/and urea group may be directly mixed with the binder resin (A). However, it is preferable that the binder resin (A) is mixed with a modified polyester resin having a relatively low molecular weight and isocyanate group at the terminal (which may be hereinafter referred to as prepolymer) and an amine reactive with the prepolymer, from the view point of productivity, to form the modified polyester resin having the urethane or/and urea group by the chain extension or/and cross-linking reactions carried out during or after the granulation. This facilitates to contain a modified polyester resin of relatively high molecular weight in the core for viscoelasticity adjustment.

(Prepolymer)

One example of the prepolymer having isocyanate group is produced by further reacting a polyester, which is a polycondensate of the polyol (1) and polycarboxylic acid (2) and has active hydrogen group, with the polyisocyanate (3). The active hydrogen groups which the polyester contains include hydroxyl group (alcoholic or phenolic), amino group, carboxyl group and mercapto group, of which alcoholic hydroxyl group is preferable.

(Polyisocyanate)

The polyisocyanate (3) includes aliphatic polyisocyanates, e.g., tetramethylene diisocyanate, hexamethylene diisocyanate and 2,6-diisocyanatomethylcaproate; alicyclic polyisocyanate, e.g., isophorone diisocyanate and cyclohexylmethane diisocyanate; aromatic diisocyanates, e.g., tolylene diisocyanate and dipohenylmethane diisocyanate; aromatic/aliphatic diisocyanates, e.g., $\alpha,\alpha,\alpha',\alpha'$-tetramethylxylylene diisocyanate; isocyanurates; the above polyisocyanates blocked with a phenol derivative, oxime, caprolactam or the like; and combinations of two or more of the above.

(Isocyanate Group/Hydroxyl Group Ratio)

The polyisocyanate (3) is incorporated to have an adequate ratio of isocyanate group [NCO] to hydroxyl group [OH] present in polyesters having hydroxyl group. The [NCO]/[OH] equivalent ratio is generally in a range from 5/1 to 1/1, preferably 4/1 to 1.2/1, more preferably 2.5/1 to 1.5/1. When the ratio is above 5, the toner may have degraded fixing ability at low temperature. When [NCO] is below 1, the toner may have degraded offset resistance because of insufficient urea content in the modified polyester. The prepolymer (A) having isocyanate group at the terminal contains the polyisocyanate (3) generally at 0.5% by weight to 40% by weight, preferably 1% by weight to 30% by weight, more preferably 2% by weight to 20% by weight. At a content below 0.5% by weight, the toner may have degraded offsetting resistance. At a content of above 40% by weight, on the other hand, toner may have degraded fixing ability at low temperature.

(Number of Isocyanate Groups in Prepolymer)

The prepolymer (A) having isocyanate group generally contains one or more isocyanate groups per molecule, preferably 1.5 groups to 3 groups on the average, more preferably 1.8 groups to 2.5 groups on the average. When the number is below 1, the modified polyester may have an insufficient molecular weight and degraded offsetting resistance after it is subjected to chain extension and/or cross-linking.

(Chain Extending and/or Cross-Linking Agents)

The chain extending and/or cross-linking agents for the present invention include amines (B). Examples of amines (B) include diamines (B1), trivalent or higher polyamines (B2), aminoalcohols (B3), aminomercaptans (B4), amino acids (B5), and B1 to B5 amines whose amino group is blocked (B6).

Diamines (B1) include the followings:

Aromatic diamines, e.g., phenylenediamine, dethyltoluenediamine, 4,4'-diaminodiphenylmethane, tetrafluoro-p-xylylenediamine and tetrafluoro-p-phenylenediamine;

Alicyclic diamines, e.g., 4,4'-diamino-3,3'-dimethyldicyclohexylmethane, diaminecyclohexane and isophorondiamine;

Aliphatic diamines, e.g., ethylenediamine, tetramethylenediamine, hexamethylenediamine, dodecafluorohexylenediamine and tetracosafluorododecylenediamine.

Trivalent or higher diamines (B2) include diethylene triamine and triethylenetetramine.

Amino alcohols (B3) include ethanol amine and hydroxyethylaniline.

Aminomercaptans (B4) include aminoethylmercaptan and aminopropylmercaptan.

Amino acids (B5) include aminopropionic acid and aminocaproic acid.

B1 to B5 amines whose amino group is blocked (B6) include ketimine and oxazoline compounds obtained from one of B1 to B5 amines with a ketone (e.g., acetone, methylethylketone or methylisobutylketone).

(Reaction Terminator)

The chain extension and/or cross-linking reaction may be terminated by a reaction terminator, as required, to adjust molecular weight of the modified polyester after the reaction. Reaction terminators include monoamines (e.g., diethylamine, dibutylamine, butylamine and laurylamine), and these compounds whose amino group is blocked (ketimine compound).

(Amino Group/Isocyanate Group Ratio)

The amine (B) is incorporated to have an adequate ratio of isocyanate group [NCO] present in the prepolymer (A) having isocyanate group to amino group [NHx] present in the amine (B). The [NCO]/[NHx] equivalent ratio is generally in a range from 1/2 to 2/1, preferably 1.5/1 to 1/1.5, more preferably 1.2/1 to 1/1.2. When the ratio is above 2 or below 1/2, the urea-modified polyester (i) may have insufficient molecular weight and degraded hot offsetting resistance.

<Colorant>

Any known dye or pigment may be used as a colorant for the present invention. They include carbon black, nigrosine dye, iron black, naphthol yellow S, hanza yellow (10G, 5G and G), cadmium yellow, yellowish iron oxide, ocher, chrome yellow, titanium yellow, polyazo yellow, oil yellow, hanza yellow (GR, A, RN and R), pigment yellow L, benzidine yellow (G and GR), permanent yellow (NCG), vulkan fast yellow (5G and R), tartrazine lake, quinoline yellow lake, anthrazane yellow BGL, isoindolinone yellow, colcothar, red lead, cinnabar lead, cadmium red, cadmium mercury red, cinnabar antimony, permanent red 4R, para red, fire red, parachlororthonitroaniline red, lithol fast scarlet G, brilliant fast scarlet, brilliant carmine BS, permanent red (F2R, F4R, FRL, FRLL and F4RH), fast scarlet VD, belkan fast rubine B, brilliant scarlet G, lithol rubine GX, permanent red F5R, brilliant carmine 6B, pigment scarlet 3B, Bordeaux 5B, toluidine maroon, permanent Bordeaux F2K, heliobordeaux BL, Bordeaux 10B, bon maroon light, bon maroon medium, eosin lake, rhodamine lake B, rhodamine lake Y, alizarin lake, thioindigo red B, thioindigo maroon, oil red, quinaquridone red, pyrazolone red, polyazo red, chrome vermilion, benzidine orange, perinone orange, oil orange, cobalt blue, cerulean blue, alkali blue lake, peacock blue lake, Victoria blue lake, nonmetallic phthalocyanine blue, phthalocyanine blue, fast sky blue, indanthrene blue (RS and BC), indigo, ultramarine blue, Prussian blue, anthraquinone blue, fast violet B, methyl violet lake, cobalt purple, manganese purple, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, zinc flower, lithobone, and mixtures thereof. The colorant is incorporated in the toner generally at 1% by weight to 15% by weight, preferably 3% by weight to 10% by weight.

<Formulation of Colorant Master Batch>

The colorant for the present invention may be used in the form of master batch in which it is combined with a resin to form the composite. A binder resin used for master batch production or kneaded with a master batch includes in addition to the modified or unmodified polyester resins described above; polymers of styrene and its substitution compounds, e.g., polystyrene, poly-p-chlorostyrene, polyvinyl toluene; styrene-based copolymer, e.g., styrene/p-chlorostyrene copolymers, styrene/propylene copolymers, styrene/vinyl toluene copolymers, styrene/vinyl naphthalene copolymers, styrene/methyl acrylate copolymers, styrene/ethyl acrylate copolymers, styrene/butyl acrylate copolymers, styrene/octyl acrylate copolymers, styrene/methyl methacrylate copolymers, styrene/ethyl methacrylate copolymers, styrene/butyl methacrylate copolymers, styrene/methyl α-chlormethacrylate copolymers, styrene/acrylonitrile copolymers, styrene/vinyl methylketone copolymers, styrene/butadiene copolymers, styrene/isoprene copolymers, styrene/acrylonitrile/indene copolymers, styrene/maleic acid copolymers and styrene/maleic acid ester copolymers; polymethyl methacrylate, polybutyl methacrylate, polyvinyl chloride, polyvinyl acetate, polyethylene, polypropylene, polyester, epoxy resin, epoxypolyol resin, polyurethane, polyamide, polyvinyl butyral polyacrylic acid resin, rosin, modified rosin, terpene resin, aliphatic hydrocarbon resin, alicyclic hydrocarbon resin, aromatic-based petroleum resin, chlorinated paraffin and paraffin wax. These binder resins may be used either alone or in combination of two or more kinds.

<Method for Producing Master Batch>

The master batch can be produced by mixing and kneading a resin for the master batch and colorant under a high shear stress. They may be mixed and kneaded in the presence of an organic solvent in order to promote the interactions between them. Moreover, it may be produced by a so-called flushing method, in which an aqueous paste of colorant and water is mixed and kneaded with a resin and organic solvent to transfer the colorant to the resin side, and then the water and organic solvent are removed. It is a preferable method, because the wet colorant cake can be directly used without being dried. The mixing/kneading is preferably carried out by a high-shear dispersing machine, e.g., three-roll mill.

<Releasing Agent>

Any known releasing agent may be used for the present invention. It includes, for example, polyolefin waxes, e.g., polyethylene wax and polypropylene wax; long-chain hydrocarbons, e.g., paraffin wax and Sasol wax; and waxes containing carbonyl group. Waxes containing carbonyl group include polyalkanoic acid esters, e.g., carnauba wax, montan wax, trimethylolpropane tribehenate, pentaerithrytol tetrabehenate, pentaerithrytol diacetate dibehenate, glycerin tribehenate and 1,18-octadecanediol distearate; polyalkanol esters, e.g., tristearyl trimellitate, and distearyl maleate; polyalkanoic acid amides, e.g., ethylene diamine dibehenyl amide); polyalkyl amides, e.g., tristearylamide trimellitate; and dialkyl ketones, e.g., distearyl ketone, of which polyalkanoic acid esters are preferred. In the present invention, wax is incorporated in the toner at 3% by weight to 30% by weight relative to 100% by weight of the resin components. At a content below 3% by weight of the resin components relative to the whole toner, wax may not sufficiently exhibit the releasing effect and reduce allowance of the toner for preventing off-set. At a content above 30% by weight, on the other hand, wax is more sensitive to thermal and mechanical energy, because it melts at low temperature, and may leak out of the toner while it is stirred in a developing unit to contaminate a toner restriction member and photoconductor, causing image noise.

Wax having an endothermic peak at 65° C. to 115° C. while being heated, determined by a differential scanning calorimeter (DSC), can allow the toner to be fixed at low temperature. Wax having a melting point lower than 65° C. may not sufficiently flow, and that having a melting point higher than 115° C. may degrade fixing ability of the toner.

<Charge Control Agent>

The toner of the present invention may contain a charge control agent, as required. Any known charge control agent may be used for the present invention. It includes, for example, nigrosine-based dyes, triphenylmethane-based dyes, chromium-containing metal complex dyes, molybdenum acid chelate pigments, rhodamine-based dyes, alkoxy-based amines, quaternary ammonium salts (including fluorine-modified ones), alkyl amides, phosphorus (element or compounds), tungsten (element or compounds), fluorine-based active agents, metal salts of salicylic acid and metal salts of salicylic acid derivatives. More specifically, they include BONTRON 03, (nigrosine-based dye), BONTRON P-51 (quaternary ammonium salt), BONTRON S-34 (metal-containing azo dye), E-82 (metal complex of oxynaphthoic acid), E-84 (metal complex of salicylic acid) and E-89 (phenolic condensate) (the above is manufactured by Orient Chemical Industries, Ltd.); TP-302 and TP-415 (quaternary ammonium salt/molybdenum complex) (the above are manufactured by Hodogaya Chemical, Inc.); copy charge PSY VP2038 (quaternary ammonium salt), copy blue PR (triphenyl methane derivative), copy charge NEG VP2036 (quaternary ammonium salt), copy charge NX VP434 (the above are manufactured by Hochst); LRA-901 and LR-147 (boron complex) (the above are manufactured by Japan Carlit Co., Ltd.); copper phthalocyanine, perylene, quinacridone, azo pigments and other macromolecules having a functional group such as sulfonate group, carboxyl group, quaternary ammonium salts or the like.

<External Additive>

(Fine Inorganic Particle)

Fine inorganic particles are suitably used for an external additive which works to improve flowability, developing ability, electrostatic charge ability of the colored particles produced by the present invention. The fine inorganic particles preferably have a primary particle diameter of 5 nm to 2 μm, particularly preferably 5 nm to 500 nm. Moreover, they preferably have a BET-determined specific surface area of 20 $m^2/g$ to 500 $m^2/g$. They are incorporated preferably at 0.01% by weight to 5% by weight based on the toner, particularly preferably 0.01% by weight to 2.0% by weight. Specific examples of the fine inorganic particles include those of silica, alumina, titanium oxide, barium titanate, magnesium titanate, calcium titanate, strontium titanate, zinc oxide, tin oxide, silica sand, clay, mica, sand-lime stone, diatomaceous earth, chromium oxide, cerium oxide, colcothar, antimony trioxide, magnesium oxide, composite oxides (e.g., silicon oxide/magnesium oxide and silicon oxide/aluminum oxide), zirconium oxide, barium sulfate, barium carbonate, calcium carbonate, silicon carbide and silicon nitride.

(Fine Macromolecule Particles)

Fine macromolecule particles are also used in the present invention. These particles include those of polystyrene, methacrylic acid esters, acrylic ester copolymers produced by soap-free emulsion polymerization, suspension polymerization or dispersion polymerization; polycondensates, e.g., silicone, benzoguanamine and nylon; and polymerization particles of thermosetting resins.

(Surface Treatment with External Additive)

A fluidizer, for example, can have improved hydrophobicity by surface treatment to prevent degradation of flow and charging characteristics of the toner even under high-humidity conditions. Preferable surface treatment agents include, for example, silane coupling agent, silylation agent, silane coupling agent having a fluorinated alkyl group, organic titanate-based coupling agent, aluminum-based coupling agent, silicone oil and modified silicone oil.

(Cleaning Aid)

Cleaning property improvers for facilitating removal of a developer remaining on a photoconductor or primary transfer medium after the transferring step include, for example, metal salts of fatty acids, e.g., zinc stearate, calcium stearate, stearic acid; and fine polymer particles, e.g., those of polymethyl methacrylate and polystyrene produced by soap-free emulsion polymerization or the like. The fine polymer particles preferably have a relatively sharp particle size distribution and volume-average particle diameter of 0.01 μM to 1 μM.

<Method for Producing Toner>

The toner of the present invention can be suitably produced by the following method, although not limited thereto.

The method of the present invention for toner production at least includes a core particle granulation step in which a polyester resin, colorant and releasing agent are dissolved or dispersed in an organic solvent, and the resulting solution or dispersion is dispersed in an aqueous medium; and a subsequent step in which an aqueous dispersion with at least fine particles of vinyl-based copolymer resin dispersed is added to the core particles to attach the fine particles to the core particles.

The method is described more specifically, below.

<Granulation of Core Particles>

(Organic Solvent)

An organic solvent for dissolving or dispersing a polyester resin, colorant and releasing agent is preferably those having a Hansen solubility parameter of 19.5 or less (defined in POLYMER HANDBOOK, 4th edition, WILEY-INTERSCIENCE, volume 2, Section VII). It is also preferably volatile with a boiling point below 100° C., in terms of easiness of subsequent removal of the solvents. These organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone and methylisobutylketone. They may be used either alone or in combination of two or more kinds. Of the above compounds, those particularly preferable are esters, e.g., methyl acetate and ethyl acetate; aromatic soluvents, e.g., toluene and xylene; and halogenated hydrocarbons, e.g., methylene chloride, 1,2-dichloroethane, chloroform and carbon tetrachloride. A polyester resin, colorant and releasing agent may be dissolved or dispersed simultaneously, but generally independently. A common organic solvent or different organic solvents may be used, but preferably a common solvent in consideration of solvent treatment carried out later.

(Dissolution or Dispersion of Polyester Resin)

A polyester resin is preferably dissolved or dispersed to a resin concentration of about 40% to 80%. It will be difficult to dissolve or disperse the resin at a higher concentration, which is accompanied by increased viscosity. At a lower concentration, on the other hand, toner production rate will decrease. When the above-described modified polyester resin having a isocyanate group at terminals is mixed with the polyester resin, it may be mixed in the same solution or dispersion of the polyester resin or in different solution or dispersion, the latter being preferable in consideration of solubility and viscosity of each of them.

(Dissolution or Dispersion of Colorant)

A colorant may be dissolved or dispersed alone, or mixed in the solution or dispersion of the polyester resin. Moreover, a dispersion aid or polyester resin may be added as required, or the master batch may be used.

(Dissolution or Dispersion of Releasing Agent)

When wax is used as a releasing agent after being dissolved or dispersed in an organic solvent which sparingly dissolves wax, the wax are used as a dispersion. The dispersion can be produced by a common method in which a mixture of organic solvent and wax is subjected to a dispersing machine, e.g., bead mill, to disperse wax in the solvent. Dispersion time may be shortened by mixing an organic solvent and wax, heating the resulting mixture to wax melting point, cooling the mixture with stirring, and treating the mixture by a dispersing machine, e.g., bead mill to disperse the wax in the solvent.

Two or more types of wax may be used after being mixed with each other. To wax a dispersion aid or polyester resin may be added.

(Aqueous Medium)

An aqueous medium for the present invention may be water or a mixture of water and a solvent miscible with water. Moreover, water may be mixed with an organic solvent having a Hansen solubility parameter of 19.5 or less, used in the oil phase described above. A solvent miscible with water, when used in combination with water, is preferably incorporated at a concentration near saturation level with respect to water for improving emulsification or dispersion stability of the oil phase. Solvents miscible with water include alcohols, e.g., methanol, isopropanol and ethylene glycol; dimethyl formamide, tetrahydrofuran and cellosolves (e.g., methylcellosolve); and lower ketones (e.g., acetone and methylethylketone). The aqueous medium is incorporated generally at 50 parts by weight to 2000 parts by weight relative to 100 parts by weight of the toner composition, preferably 100 parts by weight to 1000 parts by weight. When the incorporated amount is below 50 parts by weight, toner particles of desired diameter may not be obtained because of insufficient dispersion conditions of the toner composition. On the other hand, it is not economically advantageous when the amount exceeds 2000 parts by weight.

(Inorganic Dispersant and Fine Organic Resin Particles)

It is preferable that in the aqueous medium in which the toner composition solution or dispersion is to be dispersed, an inorganic dispersant or fine organic resin particles is dispersed beforehand, because this enables particle size distribution to be sharper and dispersion stability to be improved. For the inorganic dispersants, tricalcium phosphate, calcium carbonate, titanium oxide, colloidal silica and hydroxyapatite are used. The resin for the fine organic resin particles is not limited, so long as it can form an aqueous dispersion, and may be a thermoplastic or thermosetting resin. The resin include vinyl-based resins, polyurethane resins, epoxy resins, polyester resins, polyamide resins, polyimide resins, silicon-based resins, phenol resins, melamine resins, urea resins, aniline resins, ionomer resins and polycarbonate resins. They may be used either alone or in combination of two or more kinds. Of these, vinyl-based resins, polyurethane resins, epoxy resins, polyester resins, and combination thereof are preferable, because they form an aqueous dispersion of fine, spherical resin particles more easily.

(Method for Dispersing Fine Organic Resin Particles in Aqueous Medium)

Fine organic resin particles can be dispersed in an aqueous medium by one of the following methods (a) to (h), although not limited thereto.

(a) For vinyl-based resins, the monomer as a starting material is polymerized by an adequate polymerization method, e.g., suspension polymerization, emulsion polymerization, seed polymerization or dispersion polymerization to directly produce an aqueous dispersion of fine resin particles.

(b) For polyester resins, polyurethane resins, epoxy resins and the like produced by polyaddition or condensation, a precursor (monomer, oligomer or the like), which may be beforehand dissolved in a solvent, is dispersed in an aqueous medium in the presence of an adequate dispersant, and then hardened under heating or in the presence of a hardening agent, to produce an aqueous dispersion of fine resin particles.

(c) For polyester resins, polyurethane resins, epoxy resins and the like produced by polyaddition or condensation, an adequate emulsifier is dissolved in a precursor (monomer, oligomer or the like), which may be beforehand dissolved in a solvent (liquid is preferable but solid may be used after being liquefied under heating), and then water is added to the resulting solution to effect phase-transformed emulsification.

(d) A resin produced by any polymerization method (e.g., addition polymerization, ring-opening polymerization, polyaddition polymerization, addition condensation polymerization or condensation polymerization) to have an increased molecular weight is finely crushed by a pulverizing mill, e.g., mechanically rotating type or jet type, classified to have the fine resin particles, which are then dispersed in water in the presence of an adequate dispersant.

(e) A resin produced by any polymerization method (e.g., addition polymerization, ring-opening polymerization, polyaddition polymerization, addition condensation polymerization or condensation polymerization) to have an increased molecular weight is dissolved in a solvent, and the resulting resin solution is atomization-sprayed into the fine resin particles, which are dispersed in water in the presence of an adequate dispersant.

(f) A resin produced by any polymerization method (e.g., addition polymerization, ring-opening polymerization, polyaddition polymerization, addition condensation polymerization or condensation polymerization) to have an increased molecular weight is dissolved in a solvent, and to the resulting resin solution a solvent is added, or the resin solution dissolved beforehand under heating in a solvent is cooled, to precipitate the fine resin particles, the precipitate being then treated to remove the solvent to produce the fine resin particles, which are dispersed in water in the presence of an adequate dispersant.

(g) A resin produced by any polymerization method (e.g., addition polymerization, ring-opening polymerization, polyaddition polymerization, addition condensation polymerization or condensation polymerization) to have an increased molecular weight is dissolved in a solvent, and the resulting resin solution is dispersed in an aqueous medium in the presence of an adequate dispersant, and treated under heating or a vacuum to remove the solvent.

(h) A resin produced by any polymerization method (e.g., addition polymerization, ring-opening polymerization, polyaddition polymerization, addition condensation polymerization or condensation polymerization) to have an increased molecular weight is dissolved in a solvent and to the resultant resin solution an adequate emulsifier is dissolved, to which water is added to effect phase-transformed emulsification.

(Surfactant)

To an aqueous medium, an adequate surfactant, as required, may be added, in order to facilitate emulsification and dispersion of the oil phase, in which the toner composition is contained, in an aqueous medium. The surfactants used in the present invention include anionic surfactants, e.g., alkyl benzene sulfonate, α-olefin sulfonate and phosphoric acid ester; amine salt type, e.g., alkylamine salt, aminoalcohol fatty acid derivatives, polyamine fatty acid derivatives and imidazoline; quaternary ammonium salt type cationic surfactants, e.g., alkyl trimethyl ammonium salt, dialkyl dimethyl ammonium salt, alkyl dimethylbenzyl ammonium salt, pyridinium salts, alkyl isoquinolium salt and benzethonium chloride; nonionic surfactants, e.g., fatty acid amide derivatives and polyhydric alcohol derivatives; and ampholytic surfactants, e.g., alanine, dodecyl-di-(anminoethyl)glycine, di-(octylaminoethyl)glycine and N-alkyl-N,N-dimethyl ammonium betain.

Moreover, a surfactant having a fluoroalkyl group can exhibit its effects in a very small quantity. Preferable anionic surfactants having a fluoroalkyl group include fluoroalkyl carboxylic acid of 2 to 10 carbon atoms and metal salt thereof, disodium perfluorooctanesulfonyl glutamate, sodium 3-[ω-fluoroalkyl (C6-C11)oxy]-1-alkyl (C3-C4)sulfonate, sodium 3-[ω-fluoroalkanoyl (C6-C8)-N-ethylamino]-1-propanesulfonate, fluoroalkyl carboxylic acid (C11-C20) and metal salt thereof, perfluoroalkyl carbonic acid (C7-C13) and metal salt thereof, perfluoroalkyl sulfonate (C4-C12) and metal salt thereof diethanolamide perfluorooctane sulfonate, N-propyl-N-(2-hydroxyethyl)perfluorooctane sulfonamide, perfluoroalkyl (C6-C10) sulfonamide propyltrimethyl ammonium salt, perfluoroalkyl (C6-C10)-N-ethylsulfonyl glycine salt and monoperfluoroalkyl (C6-C16) ethyl phosphoric acid ester. Cationic surfactants include aliphatic quaternary ammonium salts, e.g., aliphatic primary, secondary and tertiary amine acids having a fluoroalkyl group and perfluoroalkyl (C6-C10) sulfonamide propyltrimethyl ammonium salt, benzalconium salt, benzethonium chloride, pyridinium salt and imidazolinium salt.

(Protective Colloid)

Macromolecule protective colloid may be used to stabilize dispersed liquid droplets. For protective colloid the following may be used: acids, e.g., acrylic acid, methacrylic acid, α-cyanoacrylic acid, α-cyanomethacrylic acid, itaconic acid, crotonic acid, fumaric acid and maleic acid (including anhydride); (meth)acrylic monomer containing hydroxyl group, e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide and N-methylol methacrylamide; vinyl alcohol and ethers thereof; e.g., vinyl methyl ether, vinyl ethyl ether, vinyl propyl ether; esters of compounds having vinyl alcohol and carboxyl group, e.g., vinyl acetate, vinyl propionate and vinyl butyrate; acrylamide, methacrylamide, diacetone acrylamide and methylol compounds thereof; acid chlorides, e.g., acrylic acid chloride and methacrylic acid chloride; homopolymers and copolymers of compounds containing nitrogen or its heterocyclic ring, e.g., vinyl pyridine, vinyl pyrrolidone, vinyl imidazole or ethyleneimine; polyoxyethylene and the like, e.g., polyoxyethylene, polyoxypropylene, polyoxyethylene alkylamine, polyoxypropylene alkylamine, polyoxyethylene alkylamide, polyoxypropylene alkylamide, polyoxyethylenenonylphenyl ether, polyoxyethylenelaurylphenyl ether, polyoxyethylenestearylphenyl ester and polyoxyethylenenonylphenyl ester; and celluloses, e.g., methyl cellulose, hydroxyethyl cellulose and hydroxypropyl cellulose. When a compound soluble in acid or alkali, e.g., calcium phosphate salt is used as a dispersion stabilizer, the calcium phosphate salt is removed from the fine particles by dissolving the salt in an acid, e.g., hydrochloride and then washing with water. Moreover, it may be removed by enzyme-aided decomposition. When a dispersant is used, it may remain untreated on the toner particle surfaces, but it is preferable to remove it by washing, from the view point of toner electrostatic chargeability.

(Method for Dispersion)

The dispersion method is not particularly limited, and may be carried out by a known machine, e.g., low-speed shearing machine, high-speed shearing machine, fractioning machine, high-pressure jet machine or ultrasonic machine. Use of a high-speed shearing dispersing machine is preferable to have dispersion particle diameter of 2 μm to 20 μm. When a high-speed shearing dispersing machine is employed, its rotation speed is not particularly limited. However, it is generally 1000 rpm to 30000 rpm, preferably 5000 rpm to 20000 rpm. Dispersing temperature is generally 0° C. to 150° C. (under pressure), preferably 20° C. to 80° C.

(Desolventizing)

An organic solvent can be removed from the emulsified dispersion by a known method. For example, evaporation in which the dispersion is gradually heated under normal pressure or a vacuum may be adopted to completely remove the organic solvent from the liquid droplets.

<Fine Particle Attaching Step>

The step for attaching fine particles of vinyl-based copolymer resin to the core particles mainly composed of polyester resin is described. It is preferable for this step to use an aqueous dispersion in which at least fine particles of vinyl-based copolymer resin are dispersed. The dispersion can be easily produced by common emulsion polymerization and may be directly used in the fine particle attaching step. To the dispersion, an additive, e.g., surfactant may be added, to stabilize dispersion of the core particles and fine vinyl-based copolymer resin particles to some extent. The fine particles are preferably incorporated after an organic solvent is removed.

In the fine particle attaching step, the dispersion may be adjusted at a desired pH level with sodium hydroxide or hydrochloric acid for attaching the fine particles more efficiently. A mono- to tri-valent metallic salt may be incorporated as a flocculating agent. The mono-valent metal which constitutes the salt includes lithium, potassium or sodium. The di-valent metal includes calcium or magnesium. The tri-valent metal includes aluminum. The anion which constitutes the salt may be a chloride ion, bromide ion, iodide ion, carbonate ion or sulfate ion. The particle attachment may be accelerated under heating at not more than or not less than glass transition temperature of the fine particles. Flocculation or/and fusing among the fine particles sometimes proceeds very slowly at around their glass transition temperature or lower, and it is preferable in such a case to subsequently heat the fine particles at higher temperature to accelerate their flocculation or/and fusing, and thereby to accelerate coating of the core particles and uniformize the shell surfaces. The heating temperature and time are adequately controlled to adjust degree of surface uniformization and sphericity of the toner particles.

<Extension or/and Cross-Linking Reactions>

When a modified polyester resin having an isocyanate group at terminals and amine reactive with the resin are incorporated to introduce the modified polyester resin having urethane or/and urea group, the amine may be mixed in the oil phase before the toner composition is dispersed in an aqueous medium, or it may be mixed in the aqueous medium. The reaction time is set depending on the isocyanate group structure in the polyester prepolymer and its reactivity with the amine. It is generally in the range from 1 minute to 40 hours, preferably 1 hour to 24 hours. The reaction temperature is generally in a range from 0° C. to 150° C., preferably 20° C. to 98° C. The reaction step may be carried out before, during or after the fine particle attachment step, in the presence of a known catalyst, as required.

<Washing and Drying Steps>

The washing and drying steps for the toner particles dispersed in an aqueous medium may be carried out by known procedures.

For example, the toner particles can be produced by a series of steps, such as treatment of the dispersion by a centrifugal separator, filter press or the like for solid/liquid separation, redispersion of the resulting toner cake in ion-exchanged water kept at normal temperature to around 40° C., pH adjustment with an acid or alkali as required, and solid/liquid separation again. These steps are repeated several times to remove impurities and surfactant, and are then followed by a drying step which employs an air dryer, circulation dryer, vacuum drier, vibrational/fluidization drier or the like. The fine toner particles may be recovered by a centrifugal separator, or treated by a known classifier as required after being dried, to have a desired particle size distribution.

<Treatment with External Additive>

The dried toner powder may be mixed with dissimilar particles, e.g., those of charge control agent fine particle, fluidizer fine particle or the like described earlier. Separation of the dissimilar particles from the surface of the composite particles produced can be prevented by applying a mechanical impact to the mixed powder for fixing them on or fusing them with the toner particle surfaces. More specifically, the mechanical impact can be applied to the composite powder by a blade rotating at a high speed, or accelerating it against an impinging plate by air flowing at a high speed using an angmill (Hosokawa Micron, Ltd.), I-mill (Nippon Pneumatic MFG. Co., Ltd.) modified to operate at a decreased crushing air pressure, hybridization system (Nara Machinery Co., Ltd.), criptron system (Kawasaki Heavy Industries, Ltd.), automatic mortar or the like.

The toner of the present invention is composed of the colored particles containing a binder resin, colorant and releasing agent, to which an external additive is externally added, wherein the product of the colored particle volume-average diameter (μm) and content G of the external additive (% by weight based on the colored particles) is 5 to 21. When the product is below 5, the toner may have degraded transferability to cause image falling-off, more frequently when the toner is used to form full-color images or contains a releasing agent. Toner transferability as used in this specification means easiness of the toner image formed on a photoconductor surface being transferred onto a transfer medium. In particular, the term includes, when a toner image on a photoconductor surface is transferred onto an intermediate transfer member, e.g., intermediate transfer belt, and then onto a transfer medium, easiness of transfer of a photoconductor onto an intermediate transfer member and an intermediate transfer member onto a transfer medium. When the product is above 21, on the other hand, the toner may have degraded fixing ability to cause images of insufficient fixing strength, in particular when it is used in an image forming apparatus with a fixing unit which employs no oil-aided heating.

The external additive is in the form of fine particles of an inorganic material. Any inorganic material may be used for the agent. Some examples of the fine inorganic particles include those of silica, titania, alumina, strontium titanate, tin oxide and zinc oxide. They may be used either alone or in combination of two or more kinds. Of these inorganic materials, silica is used more suitably for its flowability and electrostatic chargeability. The fine inorganic particles are preferably surface-treated by a known procedure with a known agent, such as a common hydrophobicizing agent, e.g., silane coupling agent, titanate-based coupling agent, silicone oil or silicone varnish; fluorine-based silane coupling agent or fluorine-based silicone oil; coupling agent containing amino group or quaternary ammonium salt group; or modified silicone oil.

The toner can be measured by the following procedures.

<Method for Measurement>

(Particle Diameter)

The procedure for determining toner particle size distribution is described.

A coulter counter TA-II or Coulter multisizer II (both manufactured by Coulter Company Limited) may be used for determining the size distribution of the toner particle according to coulter counter method. The procedure which uses the above analyzer is described below.

First, into 100 mL to 150 mL of an aqueous electrolyte solution, 0.1 mL to 5 mL of a surfactant as a dispersant (preferably alkylbenzene sulfonate salt) is added. The electrolyte solution is an about 1% aqueous NaCl solution (first-grade sodium chloride), for which ISOTON-II (Coulter Company Limited) may be used. Then, 2 mg to 20 mg (as solid) of a sample is dispersed in the aqueous electrolyte solution, and treated by an ultrasonic dispersing device for about 1 minute to 3 minutes. The resulting sample-suspending electrolyte solution is analyzed using the above analyzer with 100 μm apertures to determine toner particle volume and number to calculate the volume and number distributions, from which toner volume-average particle diameter (Dv) and number-average particle diameter (Dp) can be evaluated.

For example, the particles having a diameter of 2.00 μm or more and below 40.30 μm can be analyzed by using a total of 13 channels, e.g., 2.00 μm to below 2.52 μm, 2.52 μm to below 3.17 μm, 3.17 μm to below 4.00 μm, 4.00 μm to below 5.04 μm, 5.04 μm to below 6.35 μm, 6.35 μm to below 8.00 μm, 8.00 μm to below 10.08 μm, 10.08 μm to below 12.70 μm, 12.70 μm to below 16.00 μm, 16.00 μm to below 20.20 μm, 20.20 μm to below 25.40 μm, 25.40 μm to below 32.00 μm and 32.00 μm to below 40.30 μm in size.

(Average Circularity)

For a shape analysis procedure, an optical one is suitable in which a particle-containing suspension is passed on a photographing section detection band set on a plane, to optically detect and analyze particle images photographed by a CCD camera. Average circularity is defined as a value obtained by dividing a peripheral length of equivalent circle having the same projected area by actual particle peripheral length.

Average circularity can be determined by a flow type particle image analyzer, e.g., FPIA-2000. More specifically, to 100 to 150 mL of water treated beforehand to remove solid impurities, 0.1 mL to 0.5 mL of a surfactant as a dispersant (preferably alkylbenzene sulfonate) is added, and then about 0.1 g to 0.5 g of a sample is added. The resulting suspension dispersed with the sample is treated by a ultrasonic dispersing device for about 1 minute to 3 minutes to have a concentration of 3,000 particles/μL to 10,000 particles/μL. The average circularity can be determined by measuring the toner particle shape and distribution by the above-described analyzer.

(Glass Transition Temperature)

Glass transition temperature of the polyester resin, vinyl-based copolymer resin and so forth can be determined by an adequate analyzer, e.g., differential scanning calorimeter (e.g., DSC-6220R, Seiko Instruments), where the sample is heated at 10° C./minute from room temperature to 150° C., at which it is held for 10 minutes, cooled at 10° C./minute, and then heated at 10° C./minute from 20° C. to 150° C. Glass transition temperature is defined at a shoulder point between the baseline below glass transition temperature and endothermic peak.

(Measurement of Softening Temperature (Tm))

A sample (1.0 g) is analyzed by a flow tester (CFI-500, manufactured by Shimadzu Corporation) with a die, 1.0 mm high and 0.5 mm in diameter, under conditions of heating rate: 3.0° C./minute, preheating time: 180 seconds, load: 30 kg and analysis temperature range: 60° C. to 160° C., and temperature at which half of the sample runs off is defined as softening temperature (Tm).

Fine Particle Diameter

Particle diameter of the fine vinyl-based copolymer resin particles and so forth can be determined by an analyzer, e.g., LA-920 (HORIBA, Ltd.) or UPA-EX150 (NIKKISO Co., Ltd.), where the as-produced dispersion can be directly analyzed.

EXAMPLES

The present invention is described more specifically by Examples, which by no means limit the present invention. In the Examples all of "part(s)" are by mass.

<Synthesis of Polyester>

(Polyester 1)

A reactor equipped with a cooling tube, stirrer and nitrogen inlet port was charged with 553 parts of adduct of bisphenol A with 2 mols of ethylene oxide, 196 parts of adduct of bisphenol A with 2 mols of propylene oxide, 220 parts of terephthalic acid, 45 parts of adipic acid and 2 parts dibutyl tin oxide. They were allowed to react under normal pressure and at 230° C. for 8 hours and then under a vacuum of 10 mmHg to 15 mmHg for 5 hours, to which 26 parts of trimellitic anhydride was added, and the resulting mixture was allowed to react at 180° C. and under normal pressure for 2 hours, to produce Polyester 1. It had a number-average molecular weight of 2,200, weight-average molecular weight of 5,600, Tg of 43° C. and acid value of 13.

<Synthesis of Fine Vinyl-Based Copolymer Resin Particles>

(Fine Vinyl-Based Copolymer Resin Particles S-1)

A reactor equipped with a cooling tube, stirrer and nitrogen inlet port was charged with 1.6 parts of sodium dodecyl sulfate and 492 parts of ion-exchanged water, and the resulting mixture was heated to 80° C., to which 2.5 parts of potassium persulfate (KPS) as a polymerization initiator dissolved in 100 parts of ion-exchanged water was added. To the resulting mixture, 15 minutes later, a mixed solution of 152 parts of styrene monomer, 38 parts of butyl acrylate, 10 parts of methacrylic acid and 3.5 parts of n-octyl mercaptan (NOM) (molecular weight regulator) as a monomer composition was added dropwise in 90 minutes, and then kept at 80° C. for 60 minutes. The effluent was cooled, to produce a dispersion of [fine vinyl-based copolymer resin particles S-1]. The fine particles had an average diameter of 50 nm. A small quantity of the dispersion was evaporated in a Petri dish leaving the solid, which had a number-average molecular weight of 11,000, weight-average molecular weight of 18,000 and Tg of 65° C.

<Synthesis of Prepolymer>

A reactor equipped with a cooling tube, stirrer and nitrogen inlet port was charged with 682 parts of adduct of bisphenol A with 2 mols of ethylene oxide, 81 parts of adduct of bisphenol A with 2 mols of propylene oxide, 283 parts of terephthalic acid, 22 parts of trimellitic anhydride and 2 parts of dibutyl tin oxide. They were allowed to react at 230° C. and normal pressure for 8 hours, and then under a vacuum of 10 to 15 mmHg for 5 hours, to produce [intermediate polyester 1]. It had a number-average molecular weight of 2,100, weight-average molecular weight of 9,500, Tg of 55° C., acid value of 0.5 and hydroxyl value of 49.

Next, a reactor equipped with a cooling tube, stirrer and nitrogen inlet port was charged with 411 parts of [intermediate polyester 1], 89 parts of isophorone diisocyanate and 500 parts of ethyl acetate. They were allowed to react at 100° C. for 5 hours, to produce [prepolymer 1]. It contained free isocyanate at 1.53% by weight.

<Synthesis of Master Batch>

A mixture of 40 parts of carbon black (Legal 400R, Cabot Japan K.K.), 60 parts of polyester resin as a binder resin (RS-801, Sanyo Chemical Industries, acid value: 10, Mw: 20,000 and Tg: 64° C.) and 30 parts of water was prepared by a Henschel mixer. The mixture was composed of a pigment flocculation into which water penetrated. It was kneaded by a 2 rollers kept at 130° C. on the surface for 45 minutes, and pulverized into the particles 1 mm in diameter. This produced [master batch 1].

Example 1

Preparation of Pigment/Wax (Oil Phase) Dispersion

A container equipped with a stirrer and thermometer was charged with 543.5 parts of [polyester 1], 181 parts of carnauba wax and 1450 parts of ethyl acetate, and the resulting mixture was heated with stirring to 80° C. at which it was held for 5 hours, and then cooled to 30° C. in 1 hour. Then, the container was charged with 500 parts of [master batch 1] and 100 parts of ethyl acetate, which were mixed with each other for 1 hour to produce [material dissolved solution 1].

Then, 1500 parts of [material dissolved solution 1], transferred to a container, was ball-milled to disperse the carbon black and wax using a bead mill (Ultraviscomill, manufactured by Imex Corporation) under conditions of solution charge rate: 1 kg/hour, disk circumferential speed: 6 m/second, and 3 passes in the presence of zirconia beads (0.5 mm in diameter), charged to 80% by volume. Then, 655 parts of a 65% ethyl acetate solution of [polyester 1] was added, and the resulting mixture was ball-milled under the same conditions except for pass number decreased to one, to produce [pigment/wax dispersion 1]. Ethyl acetate was added to it such that the solid was contained at 50% (130° C. for 30 minutes).

<Preparation of Aqueous Phase>

A mixture was prepared with stirring, which was composed of 968 parts of ion-exchanged water, 40 parts of 25% by weight aqueous dispersion of fine organic resin particles (copolymer of sodium salt of sulfate ester of styrene/methacrylic acid/butyl acrylate/ethylene oxide adduct of methacrylate) for stabilizing the dispersion, 150 parts of 48.5% aqueous solution of sodium dodecyldiphenyl ether disulfonate (ELEMINOL MON-7, Sanyo Chemical Industries) and 98 parts of ethyl acetate, to produce the liquid, milky white in color. It is referred to as [aqueous phase 1].

<Emulsification Step>

A mixture of 976 parts of [pigment/wax dispersion 1] and 2.6 parts of isophorone diamine as an amine compound was prepared by a TK Homomixer (now PRIMIX corp.) at 5,000 rpm for 1 minute. It was then mixed with 88 parts of [prepolymer 1] by the same mixer at 5,000 rpm for 1 minute, and then with 1,200 parts of [aqueous phase 1] by the same mixer at 8,000 to 13,000 rpm for 20 minutes, to produce [emulsified slurry 1].

<Desolventizing Agent>

[Emulsified slurry 1] was charged in a container equipped with a stirrer and thermometer, and treated at 30° C. for 8 hours to remove the solvent and prepare [dispersion slurry 1].

<Fine Particle Attachment Step>

To [dispersion slurry 1], a dispersion of [fine vinyl-based copolymer resin particles V-1] was added to have a 1/0.15 in a solid content ratio. The resulting mixture was heated to 73° C. in 30 minutes, and then a solution of 100 parts of magnesium chloride hexahydrate dissolved in 100 parts of ion-exchanged water was added to it slowly while it was kept at 73° C., and further an aqueous hydrochloric acid was added to the mixture 4 hours later to adjust the mixture at a pH of 5. It was then heated to 80° C., and cooled 2 hours later to prepare [dispersion slurry 1-2].

<Cleaning and Drying>

[Dispersion slurry 1-2] (100 parts) was cleaned and dried after it was filtered under a vacuum by the following steps:

(1) To the resulting filtration cake, 100 parts of ion-exchanged water was added, the resultant suspension was subjected to a TK Homomixer (rotation speed: 12,000 rpm) for 10 minutes, and then filtered.

(2) To the filtration cake prepared in the step (1) 900 parts of ion-exchanged water was added, the resulting suspension was subjected to a TK Homomixer (rotation speed: 12,000 rpm) for 30 minutes with ultrasonic vibration, and then filtered under a vacuum. This step was repeated until the reslurry had an electroconductivity of 10 μC/cm or less.

(3) The reslurry prepared in the step (2) was adjusted at a pH of 4 with 10% hydrochloric acid, directly stirred using a three-one motor for 30 minutes and then filtered.

(4) To the filtration cake prepared in the step (3) 100 parts of ion-exchanged water was added, the resulting suspension was subjected to a TK Homomixer (rotation speed: 12,000 rpm) for 10 minutes, and then filtered. This step was repeated until the reslurry had an electroconductivity of 10 μC/cm or less, to prepare [filtration cake 1].

[Filtration cake 1] was dried at 45° C. for 48 hours by a drier with circulated air, and sieved by a 75 μm mesh to produce [colored particles 1], which had a volume-average particle diameter (Dv) of 5.8 μm, number-average particle diameter (Dp) of 5.2 μm, Dv/Dp ratio of 1.12 and average circularity of 0.973.

The obtained [colored particles 1] were coated with an external additive by the following procedure.

[Colored particles 1] (100 parts) were mixed with 1.5 parts of hydrophobic silica (BET specific surface: 200 $m^2/g$) in a Henschel mixer (FM20C/I, Mitsuikozan Co., Ltd.) for 5 minutes to produce a toner (developer).

The mixer was equipped with an upper blade AO and lower blade ST, where the lower blade was rotated at a constant circumferential speed of 40 m/second at the edge.

Example 2

A developer was prepared in the same manner as in Example 1, except that 514.5 parts instead of 543.5 parts of [polyester 1] was used in the preparation of pigment/wax (oil phase) dispersion step, and 117 parts instead of 88 parts of [prepolymer 1] was used in the emulsification step.

Example 3

A developer was prepared in the same manner as in Example 1, except that 485.5 parts instead of 543.5 parts of [polyester 1] was used in the preparation of pigment/wax (oil phase) dispersion step, and 146 parts instead of 88 parts of [prepolymer 1] was used in the emulsification step.

Example 4

A developer was prepared in the same manner as in Example 1, except that 573.5 parts instead of 543.5 parts of [polyester 1] was used in the preparation of pigment/wax (oil phase) dispersion step, and 58 parts instead of 88 parts of [prepolymer 1] was used in the emulsification step.

Example 5

A developer was prepared in the same manner as in Example 1, except that [intermediate polyester 1] was adjusted to have a number-average molecular weight and weight-average molecular weight respective of 2,300 and 11,500 instead of 2,100 and 9,500.

Example 6

A developer was prepared in the same manner as in Example 1, except that [intermediate polyester 1] was adjusted to have a number-average molecular weight and weight-average molecular weight respective of 2,500 and 13,500 instead of 2,100 and 9,500.

Example 7

A developer was prepared in the same manner as in Example 6, except that 1.5 parts of hydrophobic silica (BET specific surface: 200 $m^2/g$) and 0.5 parts of hydrophobic silica (BET specific surface: 50 $m^2/g$) were used instead of 1.5 parts of hydrophobic silica (BET specific surface: 200 $m^2/g$).

Comparative Example 1

Synthesis of Fine Organic Particle Emulsion

A container equipped with a stirrer and thermometer was charged with 683 parts of water, 11 parts of sodium salt of sulfate ester of ethylene oxide adduct of methacrylate (ELEMINOL RS-30, Sanyo Chemical Industries), 166 parts of methacrylic acid, 110 parts of butyl acrylate and 1 part of ammonium persulfate, and the resulting mixture was stirred at 6,400 rpm/min for 30 minutes. This produced an emulsion, white in color. It was heated to 75° C. at which the components were allowed to react for 4 hours, to which 30 parts of a 1% aqueous ammonium persulfate solution was added, and the resulting mixture was matured at 75° C. for 6 hours. This produced an aqueous dispersion [fine particle dispersion 1] of a vinyl-based resin (copolymer of sodium salt of sulfate ester of methacrylic acid/butyl acrylate/ethylene oxide adduct of methacrylate). It had a volume-average particle diameter of 110 nm, as determined by LA-920. A part of [fine particle dispersion 1] was dried to isolate the resin component. It had a Tg of 58° C. and weight-average molecular weight of 130,000.

—Preparation of Aqueous Phase—

A mixture was prepared with stirring, which was composed of 990 parts of water, 83 parts of [fine particle dispersion 1], 37 parts of 48.3% aqueous solution of sodium dodecyl diphenyl ether disulfonate (ELEUMINOL MON-7, Sanyo Chemical Industries) and 90 parts of ethyl acetate. This produced a milky white liquid (which is referred to as [aqueous phase 21]).

—Synthesis of Low-Molecular-Weight Polyester—

A reactor equipped with a cooling tube, stirrer and nitrogen inlet port was charged with 229 parts of adduct of bisphenol A with 2 mols of ethylene oxide, 529 parts of adduct of bisphenol A with 3 mols of propylene oxide, 208 parts of terephthalic acid, 46 parts of adipic acid and 2 parts of dibutyl tin oxide. They were allowed to react under normal pressure at 230° C. for 7 hours, and then under a vacuum of 10 mmHg to 15 mmHg for 5 hours, to which 44 parts of trimellitic anhydride was added, and the resulting mixture was allowed to react at 180° C. and under normal pressure for 3 hours, to produce [low-molecular-weight polyester 1]. It had a number-average molecular weight of 2,300, weight-average molecular weight of 6,700, Tg of 43° C. and acid value of 24.

—Synthesis of Intermediate Polyester—

A reactor equipped with a cooling tube, stirrer and nitrogen inlet port was charged with 682 parts of adduct of bisphenol A with 2 mols of ethylene oxide, 81 parts of adduct of bisphenol A with 2 mols of propylene oxide, 283 parts of terephthalic acid, 22 parts of trimellitic anhydride and 2 parts of dibutyl tin oxide. They were allowed to react at 230° C. and under normal pressure for 7 hours, and then under a vacuum of 10 mmHg to 15 mmHg for 5 hours, to produce [intermediate polyester 2]. It had a number-average molecular weight of 2,200, weight-average molecular weight of 9,700, Tg of 54° C., acid value of 0.5 and hydroxyl value of 52.

Next, a reactor equipped with a cooling tube, stirrer and nitrogen inlet port was charged with 410 parts of [intermediate polyester 2], 89 parts of isophorone diisocyanate and 500 parts of ethyl acetate. They were allowed to react at 100° C. for 5 hours, to produce [prepolymer 2]. It contained free isocyanate at 1.53% by weight.

—Synthesis of Ketimine—

A container equipped with a stirrer and thermometer was charged with 170 parts of isophorone diamine and 75 parts of methylethylketone, and they were allowed to react at 50° C. for 4 hours and 30 minutes, to produce [ketimine compound 1]. It had an amine value of 417.

—Synthesis of Master Batch (MB)—

A mixture of 1,200 parts of water, 540 parts of carbon black (Printex 35, DBP oil absorptivity: 42 mL/100 mg, pH: 9.5, manufactured by Degussa) and 1,200 parts of a polyester resin was prepared by a Henschel mixer (Mitsuikozan Co., Ltd.), kneaded by a kneaded with 2 rollers at 130° C. for 1 hour, cold-rolled, and pulverized with a pulverizer to produce [master batch 2].

—Preparation of Oil Phase—

A container equipped with a stirrer and thermometer was charged with 378 parts of [low-molecular-weight polyester 1], 100 parts of carnauba wax and 947 parts of ethyl acetate, and the resulting mixture was heated with stirring to 80° C. at which it was held for 5 hours, and then cooled to 30° C. in 1 hour. Then, the container was charged with 500 parts of [master batch 2] and 500 parts of ethyl acetate, which were mixed for 1 hour to produce [material dissolved solution 2].

Then, 1,324 parts of [material dissolved solution 2], transferred to a container, was ball-milled to disperse the carbon black and wax using a bead mill (Ultraviscomil, Imex Corporation) under conditions of solution charge rate: 1 kg/hour, disk circumferential speed: 6 m/second, and 3 passes in the presence of zirconia beads (0.5 mm in diameter), charged to 80% by volume. Then, 1,324 parts of a 65% ethyl acetate solution of [low-molecular-weight polyester 1] was added, and the resulting mixture was ball-milled under the same conditions except for pass number decreased to 2, to produce [pigment/wax dispersion 2]. It contained the solid at 50%, when treated at 130° C. for 30 minutes.

—Emulsification and Desolventizing—

A mixture of 749 parts of [pigment/wax dispersion 2], 115 parts of [prepolymer 2] and 2.9 parts of [ketimine compound 1], put in a container, was prepared by a TK Homomixer (now PRIMIX corp.) at 5,000 rpm for 2 minute. Then, 1,200 parts of [aqueous phase 2] was added to the container, and mixed with the above mixture by the TK Homomixer at 13,000 rpm for 50 minutes, to produce [emulsified slurry 2].

[Emulsified slurry 2] was poured into a container equipped with a stirrer and thermometer, and treated at 30° C. for 8 hours to remove the solvent, and then matured at 45° C. for 7 hours to prepare [dispersion slurry 2].

—Cleaning and Drying—

[Dispersion slurry 2] (100 parts) was cleaned and dried after it was filtered under a vacuum by the following steps:

(I) To the resulting filtration cake, 100 parts of ion-exchanged water was added, the resulting suspension was subjected to a TK Homomixer (rotation speed: 12,000 rpm) for 10 minutes, and then filtered.

(II) To the filtration cake prepared in the step (I), 100 parts of a 10% aqueous solution of sodium hydroxide was added, the resulting suspension was subjected to a TK Homomixer (rotation speed: 12,000 rpm) for 30 minutes, and then filtered under a vacuum.

(III) To the filtration cake prepared in the step (II), 100 parts of 10% hydrochloric acid was added, the resulting suspension was subject to a TK Homomixer (rotation speed: 12,000 rpm) for 10 minutes, and then filtered.

(IV) To the filtration cake prepared in the step (III), 300 parts of ion-exchanged water was added, the resulting suspension was subjected to a TK Homomixer (rotation speed: 12,000 rpm) for 10 minutes, and then filtered. This step was repeated twice to prepare [filtration cake 2].

[Filtration cake 2] was dried at 45° C. for 48 hours by a drier with circulated air, and sieved by a 75 μm mesh to prepare colored particles, to which the externally additive was added in the same manner as in Example 1, to prepare a developer.

Comparative Example 2

A mixture of 700 parts of ion-exchanged water and 450 parts of a 0.1M aqueous solution of $Na_3PO_4$ was heated to 60° C., and stirred in a mixer (CLEARMIX CLS-30S (M-TECHNIQUE) at 4,500 rpm, to which 68 parts of 0.1 M aqueous solution of $CaCl_2$ was added slowly, to prepare an aqueous medium containing calcium phosphate.

Next, the following materials were heated to 60° C. to be uniformly dissolved or dispersed:

| | |
|---|---|
| Styrene | 160 parts |
| N-butyl acrylate | 40 parts |
| C.I. Pigment blue 15:3 | 10 parts |
| Metal compound of di-t-butyl salicylate | 2 parts |
| Saturated polyester (acid value: 15, peak molecular weight: 12,000) | 10 parts |
| Ester-based wax (melting point: 60° C.) | 30 parts |
| Divinyl benzene | 0.3 parts |

In the resulting dispersion, 5 parts of 2,2'-azobis(2,4-dimethyl valeronitrile) as a polymerization initiator was dissolved, to prepare a polymerizable monomer composition.

To the above-described aqueous medium the polymerizable monomer composition described above was added, and the resulting mixture was stirred in a mixer (CLEARMIX) at 65° C. and 4,500 rpm in a nitrogen atmosphere for 15 minutes, to granulate the polymerizable monomer composition.

It was heated to 70° C. and polymerized for 12 hours with stirring by a paddle stirrer. The polymerization effluent was treated at 80° C. under a vacuum to distill off the residual monomer, cooled, to which hydrochloric acid was added to dissolve the calcium phosphate, and the resultant mixture was filtered, washed with water and dried to produce colored resin particles. The external additive was added in the same manner as in Example 7, to produce a developer.

It had a weight-average molecular weight (Mw) of 500,000.

Comparative Example 3

Preparation of Colored Particles

| Preparation of binder resin dispersion (1) | |
|---|---|
| Styrene | 290 parts |
| N-butyl acrylate | 110 parts |
| Acrylic acid | 6 parts |
| Dodecanethiol | 6 parts |
| Carbon tetrabromide | 4 parts |

(all were supplied from Wako Pure chemical Industries, Ltd.)

The polymerizable composition, produced by mixing/dissolving the above components, was emulsified/dispersed in a flask in the presence of 6 parts of nonionic surfactant (Nonipol 400, Sanyo Chemical Industries) and 10 parts of an anionic surfactant (Neogen S C, Dairichi Kogyo Seiyaku Co., Ltd.) dissolved in 550 parts of ion-exchanged water, to which 4 parts of ammonium persulfate (Wako Pure Chemical Industries, Ltd.) dissolved in 50 parts of ion-exchanged water was added slowly with stirring in 20 minutes. The flask was purged with nitrogen and heated to 80° C. in an oil bath with stirring, at which the mixture was held for 5 hours for continuing the emulsion polymerization.

This produced binder resin dispersion (1), in which the resin particles having a number-average particle diameter of 125 nm, glass transition temperature (Tg) of 49° C. and weight-average molecular weight Mw of 32,500 were dispersed.

| Preparation of binder resin dispersion (2) | |
|---|---|
| Styrene | 340 parts |
| N-butyl acrylate | 60 parts |
| Acrylic acid | 6 parts |
| Dodecanethiol | 6 parts |
| Carbon tetrabromide | 4 parts |

(all were supplied from Wako Pure chemical Industries, Ltd.)

The polymerizable composition, produced by mixing/dissolving the above components, was emulsified/dispersed in a flask in the presence of 6 parts of nonionic surfactant (Nonipol 400, Sanyo Chemical Industries) and 12 parts of an anionic surfactant (Neogen S C, Dairichi Kogyo Seiyaku Co., Ltd.) dissolved in 550 parts of ion-exchanged water, to which 3 parts of ammonium persulfate (Wako Pure Chemical Industries, Ltd) dissolved in 50 parts of ion-exchanged water was added slowly with stirring in 10 minutes. The flask was purged with nitrogen and heated to 70° C. in an oil bath with stirring, at which the mixture was held for 5 hours for continuing the emulsion polymerization.

This produced binder resin dispersion (2), in which the resin particles having a number-average particle diameter of 215 nm, glass transition temperature (Tg) of 64.8° C. and weight-average molecular weight Mw of 49,000 were dispersed.

| Preparation of colorant dispersion | |
|---|---|
| Carbon black (Mogal L, supplied by Cabot Japan K.K) | 50 parts |
| Nonionic surfactant (Nonipol 400, supplied by Sanyo Chemical Industries) | 5 parts |
| Ion-exchanged water | 200 parts |

The mixture, produced by mixing/dissolving the above components, was dispersed by a homogenizer (ULTRA-TURRAX T50, manufactured by IKA) for 10 minutes to prepare colorant dispersion in which the colorant (black pigment) particle having a volume-average particle diameter of 200 nm was dispersed.

| Preparation of releasing agent dispersion (1) | |
|---|---|
| Paraffin wax (HNP0190, melting point: 85° C., manufactured by Nippon Seiro Co., Ltd.) | 50 parts |
| Cationic surfactant (Sanisol B50, manufactured by Kao Corporation) | 5 parts |
| Ion-exchanged water | 200 parts |

The mixture of the above components, put in a round-bottom stainless steel flask, was dispersed by a homogenizer (ULTRA-TURRAX T50, manufactured by IKA) for 10 minutes, and then by a homogenizer discharging the dispersion under pressure to prepare releasing agent dispersion (1) in which the releasing agent particle having a number-average particle diameter of 160 nm was dispersed.

| Preparation of colored particles 1 | |
|---|---|
| Binder resin dispersion (1) | 150 parts |
| Colorant dispersion | 200 parts |
| Releasing Agent Dispersion (1) | 40 parts |
| Cationic surfactant (Sanisol B50, manufactured by Kao Corporation) | 1.5 parts |

The mixture of the above components, put in a round-bottom stainless steel flask, was dispersed by a homogenizer (ULTRA-TURRAX T50, manufactured by IKA), and heated to 48° C. in 150 minutes while stirring the mixture in the flask in an oil bath and further to 52° C. in 100 minutes. To it 100 parts of binder resin dispersion (2) were added while it was kept at 52° C., and to the resultant mixture left to stand for 15 minutes, 3 parts of an anionic surfactant (Neogen R K, manufactured by Dai-Ichi Kogyo Seiyaku Co., Ltd.) were added. The resulting mixture was heated to 93° C. after the stainless steel flask was closed by magnetic sealing, while stirring was continued, at which it was held for 2 hours. The reaction effluent was filtered, after it was cooled, washed thoroughly with ion-exchanged water and dried to prepare colored particles (developer). To them the external additive was added in the same manner as in Example 7, to produce a developer.

Comparative Example 4

Toner Production Example 1: Crushing Method (Production of Resin H)

A funnel was charged with 600 g of styrene as a vinyl-based monomer, 110 g of butyl acrylate, 30 g of acrylic acid and 30 g of dicumyl peroxide as a polymerization initiator. A 5 L four-mouth flask, equipped with a thermometer, stainless steel stirrer, downward flowing type condenser and nitrogen inlet port, was charged with 1,230 g of polyoxypropylene (n=2.2)-2,2-bis(4-hydroxyphenyl)propane and 290 g of polyoxyethylene (n=2.2)-2,2-bis(4-hydroxyphenyl)propane as polyols, 250 g of isododecenyl succinic anhydride, 310 g of terephthalic acid and 180 g of 1,2,4-benzene tricarboxylic anhydride as polycarboxylic acids, 7 g of dibutyl tin oxide as an esterification catalyst, and 460 g of paraffin wax (melting point: 73.3° C., endothermic peak half width, observed while it is heated in a differential scanning calorimeter: 3.9° C.) as a releasing agent. The mixture of the vinyl-based monomer and polymerization initiator was dropped in 1 hour from the funnel with stirring while it was kept at 160° C. by a mantle heater in a nitrogen atmosphere. The addition polymerization was matured at 160° C. for 2 hours, and then the reaction system was heated to 230° C. for polycondensation. Degree of polymerization was determined by a flow tester, in which softening temperature T1/2 was monitored. The polycondensation was stopped when the softening temperature reached a desired level, to prepare resin H.

(Production of Resin 1)

A 5 L four-mouth flask, equipped with a thermometer, stainless steel stirrer, downward flowing type condenser and nitrogen inlet port, was charged with 2,210 g of polyoxypropylene (n=2.2)-2,2-bis(4-hydroxyphenyl)propane as a polyol, 850 g of terephthalic acid and 120 g of 1,2,4-benzene tricarboxylic anhydride as polycarboxylic acids, and 0.5 g of dibutyl tin oxide as an esterification catalyst. The resulting mixture was heated to 230° C. by a mantle heater in a nitrogen atmosphere for polycondensation. Degree of polymerization was determined by a flow tester, in which softening temperature T1/2 was monitored. The polycondensation was stopped when the softening temperature reached a desired level to prepare resin L.

A mixture of 30 parts of resin H, 70 parts of resin L, 1 part of a metal salt of salicylic acid derivative as a charge control agent and 5 parts of carbon black (Mogal L, supplied by Cabot Japan K.K.) as a colorant was prepared by a blender, kneaded by a biaxial extruder, cooled, crushed and classified to prepare colored resin particles. To them the external additive was added in the same manner as in Example 7, to prepare a developer.

The toner prepared in each of Examples 1 to 7 and Comparative Examples 1 to 5 was evaluated for the following aspects.

(Uneven Concentration)

A total of 2000 copies with a given printed pattern were continuously produced by a printer (ipsio CX2500, manufactured by Ricoh Company, Ltd., modified to have a developing roller diameter of 12 mm, this printer was used throughout the evaluation works) at a printing ratio of 6% under N/N conditions (23° C., 45% RH). A total of 2000 copies with a solid pattern (printing ratio: 100%) were also produced under the same conditions.

A: No unevenness is observed in the image.

B: Unevenness is observed to some extent in the image, which causes no practical problems.

C: Unevenness is observed at least on one type of images to an extent that causes practical problems.

Image Falling-Off

A total of 2000 copies with a given print pattern were continuously produced by the same printer, with each developing unit filled with the same toner, at a printing ratio of 6% under N/N conditions (23° C., 45% RH) for evaluation of image falling-off. An image of common pattern was produced, with a total quantity of the toner attaching to the intermediate transfer member adjusted at 1.4 mg/cm$^2$ by a bias.

A: No image falling-off is observed in the image.

B: Image falling-off is observed in the image to some extent, which causes no practical problems.

C: Image falling-off is observed in the image massively to an extent that causes practical problems.

(Reverse Transfer)

A given print pattern was produced by the same printer, with each developing unit filled with the same toner, at a printing ratio of 6% under N/N conditions (23° C., 45% RH) for evaluation of reverse transfer, where a cleaning blade for the photoconductor was removed. Development and primary transfer were carried out only in a first station to form an image on an intermediate transfer member, to confirm the toner transferred back to a photoconductor in a second station.

A: No reverse transfer is observed on the photoconductor.

B: Reverse transfer is observed on the photoconductor to some extent, which causes no practical problems.

C: Reverse transfer is observed on the photoconductor massively to an extent that causes practical problems.

(Fixing Ability Evaluation)

A 36 mm wide band-shape unfixed solid image (toner quantity: 9 g/m$^2$) was formed 3 mm apart from the edge on an A-4 size copy paper using the toner (developer) to which the external additive was added and the printer (ipsio CX2500, manufactured by Ricoh company, Ltd.). The unfixed image was fixed by a fixing unit, described later, at temperature varied at 10° C. intervals in a range from 130° C. to 190° C., to determine a separable/non-offsetting temperature range as a fixing temperature range in which the paper can be smoothly separated from the heating roller, no offsetting phenomenon occurs and the image is not easily separated from the paper. The copy paper was a 45 g/m$^2$ Y-mesh one and sent in the portrait direction, which represents the conditions unfavorable for separability. The fixing device worked at a circumferential speed of 120 mm/second.

The image produced in the separable/non-offsetting temperature range was subjected to a fixing strength test (image drawing).

The fixing unit used a soft roller coated with a fluorine-based coating agent. More specifically, the heating roller had an outer diameter of 40 mm, and was composed of an aluminum core coated with an elastic layer of silicone rubber and PFA (ethylene tetrafluoride/perfluoroalkyl vinyl ether copolymer), in this order from the core, having a total thickness of 1.5 mm, where the core contained a heater. The press roller had an outer diameter of 40 mm, and was composed of an aluminum core coated with an elastic layer of silicone rubber and PFA, in this order from the core, having a total thickness of 1.5 mm.

A: The separable/non-offsetting temperature range is 50° C. or more, no toner separation is observed in the image drawing test.

B: The separable/non-offsetting temperature range is 30° C. or more and lower than 50° C. and toner separation is observed to an extent that causes no practical problems C: The separable/non-offsetting temperature range is lower than 30° C. and toner separation is observed in the image drawing test.

In Examples 2 to 7 and Comparative Examples 1 to 5, each evaluation is carried out as in the case of Example 1. The evaluation results are given in Table 1.

TABLE 1

| | Evaluation results | | | | | | | | | | | | |
|---|---|---|---|---|---|---|---|---|---|---|---|---|---|
| | Toner | | | | | Amount of external additive G (%) | | Adherence to a flat surface Fh (nN) | Adherence among particles Fr (mN) | Evaluation results | | | |
| | Particle diameter | | | | | | | | | Concentration unevenness (toner followability) | Transfer-ability | Reverse transfer | Fixing separa-bility |
| | Dv (μm) | Dp (μm) | Dv/Dp | Shape Circularity | Tm ° C. | | Dv × G | | | | | | |
| Example 1 | 5.7 | 5.0 | 1.14 | 0.97 | 129 | 1.5 | 9 | 32.8 | 290 | A | A | A | A |
| Example 2 | 5.8 | 5.1 | 1.14 | 0.98 | 132 | 1.5 | 9 | 29.7 | 270 | A | A | A | A |
| Example 3 | 5.8 | 5.0 | 1.16 | 0.98 | 134 | 1.5 | 9 | 26.2 | 260 | A | A | A | A |
| Example 4 | 5.7 | 5.0 | 1.14 | 0.98 | 125 | 1.5 | 9 | 34.1 | 310 | A | A | A | A |
| Example 5 | 5.7 | 5.0 | 1.14 | 0.98 | 132 | 1.5 | 9 | 28.6 | 270 | A | A | A | A |
| Example 6 | 5.8 | 5.1 | 1.14 | 0.98 | 135 | 1.5 | 9 | 24.5 | 250 | A | A | A | A |
| Example 7 | 5.8 | 5.1 | 1.14 | 0.98 | 135 | 2.0 | 12 | 18.1 | 200 | A | A | A | A |
| Comparative Example 1 | 5.8 | 5.2 | 1.12 | 0.95 | 120 | 1.5 | 9 | 21.6 | 460 | A | C | A | C |
| Comparative Example 2 | 7.6 | 6.5 | 1.17 | 0.97 | 131 | 2.0 | 15 | 13.0 | 250 | C | A | C | C |
| Comparative Example 3 | 6.8 | 5.8 | 1.17 | 0.98 | 112 | 2.0 | 14 | 11.2 | 350 | C | A | C | A |
| Comparative Example 4 | 6.8 | 5.6 | 1.21 | 0.94 | 129 | 2.0 | 14 | 4.7 | 480 | C | C | C | A |

The results given in Table 1 confirm that the present invention provides an image forming method and image forming apparatus which secure stable toner transferability, prevent reverse transfer of the toner back to a latent image bearing member, and show high fixing ability to produce high-quality images.

What is claimed is:

1. An image forming method comprising:

(A) a one-component developing with a toner; and (B) transferring with an intermediate transfer member, wherein the developing employs a developing roller having a diameter of 8 to 15 mm, wherein the toner has an average circularity of 0.96 or more, wherein the toner has a core/shell structure, comprising a core and a shell, wherein the toner has an adherence Fh (nN) of the toner to a flat surface satisfying the relation represented by the formula (1) and adherence Fr (mN) among toner particles satisfying the relation represented by the formula (2):

$$15 \leqq Fh \leqq 50 \quad (1)$$

$$100 \leqq Fr \leqq 400 \quad (2), \text{ and}$$

wherein a content of urea- and/or urethane-modified polyester comprised in a binder resin of the core, is 10 to 20% of the core.

2. The image forming method according to claim 1, wherein the adherence Fh (nN) of the toner to a flat surface and adherence Fr (mN) among the toner particles satisfy the relations of the formulae (3) and (4):

$$1590.5 \times 10^{-0.1103Fh} \leqq Fr \leqq 6338.9 \times 10^{-0.692Fh} \quad (3)$$

$$4Fh \leqq Fr \leqq 4Fh + 240 \quad (4).$$

3. The image forming method according to claim 1, wherein the toner has a volume-average particle diameter of 3 μm or more and 7 μm or less.

4. The image forming method according to claim 1, wherein a product of volume-average particle size (Dv, μm) of the toner and external additive content (G, %) of the toner is in a range from 5 or more and 21 or less.

5. The image forming method according to claim 1, wherein the toner comprises:

the binder resin;

a colorant; and a releasing agent.

6. The image forming method according to claim 5, wherein the binder resin comprises a polyester-comprising resin, and the polyester-comprising resin has a glass transition temperature of 40° C. or higher.

7. The image forming method according to claim 5, wherein the releasing agent comprises at least one compound selected from the group consisting of a paraffin, a synthetic ester, a polyolefin, carnauba wax, and rice wax, and the toner comprises the releasing agent at 3% by weight or more and 30% by weight or less.

8. The image forming method according to claim 1, wherein the core/shell structure comprises a vinyl-comprising copolymer in the shell.

9. The image forming method according to claim 1, wherein the developing roller has a diameter of 10 mm to 12 mm.

10. The image forming method according to claim 1, wherein a weight average molecular weight of a polyester resin of the core is from about 8,000 to 15,000.

11. An image forming apparatus comprising:

(A) a developing unit for one-component development with a toner; and (B) a transferring unit with an intermediate transfer member, wherein the developing unit is equipped with a developing roller having a diameter of 8 mm to 15 mm, wherein the toner has an average circularity of 0.96 or more, wherein the toner has a core/shell structure, comprising a core and a shell, wherein the toner has an adherence Fh (nN) of the toner to a flat surface satisfying the relation represented by the formula (1) and adherence Fr (mN) among toner particles satisfying the relation represented by the formula (2):

$$15 \leqq Fh \leqq 50 \quad (1)$$

$$100 \leqq Fr \leqq 400 \quad (2), \text{ and}$$

wherein a content of urea- and/or urethane-modified polyester comprised in a binder resin of the core, is 10 to 20% of the core.

12. The image forming apparatus according to claim 11, wherein the adherence Fh (nN) of the toner to a flat surface and adherence Fr (mN) among the toner particles satisfy the relations of the formulae (3) and (4):

$$1590.5 \times 10^{-0.1103Fh} \leqq Fr \leqq 6338.9 \times 10^{-0.692Fh} \quad (3)$$

$$4Fh \leqq Fr \leqq 4Fh + 240 \quad (4).$$

13. The image forming apparatus according to claim 11, wherein the toner has a volume-average particle diameter of 3 μm or more and 7 μm or less.

14. The image forming apparatus according to claim 11, wherein a product of volume-average particle size (Dv, μm) of the toner and external additive content (G, %) of the toner is in a range from 5 or more and 21 or less.

15. The image forming apparatus according to claim 11, wherein the toner comprises:

the binder resin;

a colorant; and a releasing agent.

16. The image forming apparatus according to claim 15, wherein the binder resin comprises a polyester-comprising resin, and the polyester-comprising has a glass transition temperature of 40° C. or higher.

17. The image forming apparatus according to claim 15, wherein the releasing agent comprises at least one compound selected from the group consisting of a paraffin, a synthetic ester, a polyolefin, carnauba wax, and rice wax, and the toner comprises the releasing agent at 3% by weight or more and 30% by weight or less.

18. The image forming apparatus according to claim 11, wherein the core/shell structure comprises a vinyl-comprising copolymer in the shell.

19. The image forming apparatus according to claim 11, wherein the developing roller has a diameter of 10 mm to 12 mm.

20. The image forming apparatus according to claim 11, wherein a weight average molecular weight of a polyester resin of the core is from about 8,000 to 15,000.

* * * * *